US005517167A

United States Patent [19]

Yamamoto et al.

[11] Patent Number: 5,517,167

[45] Date of Patent: May 14, 1996

[54] MAGNETIC COIL, MAGNETIC CONTACTOR USING MAGNETIC COIL, AND MAGNETIC COIL MANUFACTURING METHOD

[75] Inventors: Kyoichi Yamamoto; Shigeharu Ootsuka, both of Aichi, Japan

[73] Assignees: Mitsubishi Denki Kabushiki Kaisha; Mitsubishi Electric Engineering Co. Ltd., both of Tokyo, Japan

[21] Appl. No.: 203,563

[22] Filed: Mar. 1, 1994

[30] Foreign Application Priority Data

Mar. 1, 1993 [JP] Japan ..... 5-040044

[51] Int. Cl.[6] ..... H01H 67/02

[52] U.S. Cl. ..... 335/132; 335/202

[58] Field of Search ..... 335/78–86, 131, 335/132, 202

[56] References Cited

U.S. PATENT DOCUMENTS 4,724,410 2/1988 Degenhart ..... 335/132

5,059,930 10/1991 Ootsuka ..... 335/132

FOREIGN PATENT DOCUMENTS 2629632 10/1989 France .

*Primary Examiner*—Lincoln Donovan

*Attorney, Agent, or Firm*—Sughrue, Mion, Zinn, Macpeak & Seas; Richard C. Turner

[57] ABSTRACT

A magnetic coil, a magnetic contactor using the magnetic coil and a method for manufacturing the magnetic coil are disclosed wherein the magnetic coil does not need increased winding space and can be configured as having two coil terminals protruding in only one direction or as having three coil terminals. A three terminal-type magnetic contactor which uses the magnetic coil does not require an increased amount of space for the winding process, and the size of the three terminal version is reduced while still meeting insulation requirements. The magnetic coil maintains reliable electrical connection even when subjected to mechanical vibration.

14 Claims, 17 Drawing Sheets

MAGNETIC COIL, MAGNETIC CONTACTOR USING MAGNETIC COIL, AND MAGNETIC COIL MANUFACTURING METHOD

BACKGROUND OF THE INVENTION

1. Field of the Invention

The present invention relates to a magnetic coil having three terminals for energization, a magnetic contactor using said magnetic coil, and a manufacturing method for said magnetic coil.

2. Description of the Background Art

FIG. 12 illustrates the arrangement of a magnetic coil and its peripheral elements in a conventional magnetic contactor which allows the magnetic coil to be energized via three terminal blocks. FIG. 13 illustrates a sectional view of the conventional magnetic contactor in FIG. 12. In these drawings, a magnetic coil 1, a coil frame 2 of the magnetic coil, a first terminal groove 2*a* formed in the coil frame 2, a second terminal groove 2*b* positioned opposite to the first terminal groove 2*a*, a winding 3 provided on the coil frame 2, a first coil terminal 4 press-fitted in the first terminal groove 2*a* of the coil frame 2, and a first terminal portion provided at the front end of the first coil terminal 4 and constituting an external wiring portion are shown. A start-of-winding tying portion 4*b* projects from the side face of the first coil terminal 4 and a second coil terminal 5 is disposed opposite to the first coil terminal 4 and press-fitted in the second terminal groove 2*b* of the coil frame 2. A second terminal portion 5*a* is provided at the front end of the second coil terminal 5, positioned opposite to the first terminal portion 4*a*, and constitutes an external wiring portion. An end-of-winding tying portion 5*b* projects from the side face of the second coil terminal 5, and a third terminal 5*c* is provided at the other end of the second coil terminal 5, positioned diagonally opposite to the first terminal portion 4*a*, and has a third terminal portion which constitutes an external wiring portion.

A case 6 accommodates the magnetic coil 1, supports the coil frame 2, and supports the terminal portions of the first coil terminal 4 and the second coil terminal 5. Panel installation holes 6*a* are disposed diagonally in the bottom surface of the case. A first terminal supporter 6*b*, a second terminal supporter 6*c* and a third terminal supporter 6*d*, support the terminal portions of the first terminal supporter 4 and the second terminal supporter 5. An E-shaped fixed core 7 has a central pole which is inserted into the magnetic coil 1 to support the coil frame 2 from the bottom surface. A movable core 8 is opposed to the fixed core 7 and is moved vertically by magnetic force generated by the magnetic coil 1. A contact support frame 9 is fixed to the movable core 8 and movable contacts 10 are switched on/off by the operation of the contact support frame 9. Fixed contacts 11 are opposed to the movable contacts 10, and a housing 12 secures the fixed contacts 11 and supports the contact support frame 9. A first terminal block 13 is constituted by the first terminal portion 4*a* and the first terminal supporter 6*b*. A second terminal block 14 is constituted by the second terminal portion 5*b* and the second terminal supporter 6*c*, and a third terminal block is constituted by the third terminal portion and the third terminal supporter 6*d*.

FIG. 14 illustrates a perspective view of the conventional magnetic coil showing the details of the coil frame 2 and the second coil terminal 5 in the arrangement of the magnetic contactor in FIG. 12, wherein a first press-fitting projection 21 is formed in a substantially L shape by cutting part of the second coil terminal 5. A second press-fitting projection 22 is opposed to the first press-fitting projection 21 and is formed in an oppositely substantially L shape to the first press-fitting projection 21. Catch projections 23 are formed by extrusion and a cross groove 24 is formed between the thin-wall plates of the coil frame 2 in the second terminal groove 2*b* of the coil frame 2. A first press-fitting groove 25 is formed perpendicularly to the cross groove 24. A second press-fitting groove 26 is opposed to the first press-fitting groove 25, and catch holes 27 are formed so as to pierce the upper thin-wall plate of the cross groove 24.

FIG. 15 is a perspective view showing the terminal block section of the conventional magnetic contactor disclosed in Japanese Laid-Open Patent Publication No. HEI 2-284325, wherein parts 21–26 correspond to those in the conventional art in FIG. 14.

The conventional magnetic contactor having three coil terminals is arranged as described above, and the first terminal block 13 and the second terminal block 14 are disposed on the power supply side of the magnetic contactor, spaced a sufficiently insulated distance away from the wiring to the power supply side of the fixed contacts 11, and wired unidirectionally. The third terminal block 15 is disposed diagonally opposite to the first terminal block 13 and is employed when wiring is employed on both the power supply side and load side of the magnetic contactor. When the magnetic contactor is wired, the first terminal block 13 and the second terminal block 14 can be wired, and at the same time, the first terminal block 13 and the third terminal block 15 can also be wired to allow a worker to select the terminal blocks according to the ease of wiring. When a thermal relay or the like has been fitted to the load side of the magnetic contactor, that terminal block which interferes with wiring can be avoided.

When the magnetic contactor according to the conventional art in FIG. 12 is installed to a panel, the magnetic contactor is fixed to the panel before the second terminal block 14 is wired since the panel installation hole 6*a* is arranged under the second terminal block 14, and is accessed with a screwdriver obliquely from the top to avoid the second terminal block 14.

The magnetic coil 1 is assembled with consideration given to winding workability. The first coil terminal 4 and the second coil terminal 5 integrated with the third coil terminal 5*c* are fitted to the coil frame 2, the start point of the winding 2 is soldered to the start-of-winding tying portion 4*b*, the winding is subsequently wound by a winder, and finally the winding end point is soldered to the end-of-winding tying portion 5*b*.

The first coil terminal 4 and the second coil terminal 5 are fitted to the coil frame 2 as shown in FIG. 14 (only terminal 5 is illustrated). The first press-fitting projection 21 and the second press-fitting projection 22 are inserted into the first press-fitting groove 25 and the second press-fitting groove 26, and the opposed inner faces of the first press-fitting projection 21 and the second press-fitting projection 22 are pressed against and fixed to the wall surfaces in the second terminal groove 2*b*. Further, the catch projections 23 and the catch holes 27 engage to prevent removal after press-fitting. When press-fitting fixture and engagement are executed simultaneously as shown in FIG. 15, the permanent engagement effect can be increased.

In the process of winding the magnetic coil 1 of said magnetic contactor, as shown in FIG. 17, a winder provided with a series of winding shafts, each of which is inserted into the center hole of a coil frame 2, is employed, and the winding shafts are rotated synchronously to rotate the coil frames 2, thereby winding the magnetic coils.

However, whereas the conventional magnetic coil 1 is improved in wiring performance because it has three terminals, projecting from both ends of the coil frame 2, the winding shaft-to-winding shaft distance which is equal to the value of [(the maximum radius 28)×2+(the clearance 29)], required for the winder, i.e., the dimensions of each winding station, must be increased as compared to that for generally used magnetic coils on which two coil terminals project in only one direction, whereby the winding work space is increased.

The magnetic contactor is desired to be compact to reduce the size of the control box in which the contactors are arranged and to make the control box more compact and slim.

However, since the winding of the conventional magnetic coil 1 is done after the fitting of the first coil terminal 4 and the second coil terminal 5 integrated with the third terminal 5*c* between the flanges of the coil frame 2, winding is not easily carried out. If the first coil terminal 4, the second coil terminal 5 and the third coil terminal 5*c* are located higher than the flanges of the coil frame 2, this poses a problem of electrical insulation between the terminal blocks and a main circuit or an auxiliary circuit located above them. Hence, the first coil terminal 4, the second coil terminal 5 and the third coil terminal 5*c* are projected in both directions and secured to the flange height positions of the coil frame 2.

For this reason, attempts to make the magnetic contactor more compact are limited by the insulation relationship between said coil terminal blocks and the main circuit or auxiliary circuit located above them, whereby the magnetic contactor cannot be made sufficiently compact.

Also, according to the usual form of magnetic contactor, e.g., when a thermal relay is fitted beforehand in close contact with the load side of the magnetic contactor, the terminal block located on the thermal relay side cannot be used due to interference with the thermal relay. In such a case, three terminal blocks are not required and a magnetic contactor having only two coil terminals projecting in only one direction is desirable in view of product costs and the like.

However, since the conventional magnetic coil 1 has three terminals projecting from both ends of the coil frame 2 for improvement in wiring performance, the third terminal will be wasted when said magnetic coil is employed as above.

Further, in the conventional magnetic contactor, the forces applied to the device during manufacture vary in direction, particularly with respect to the second terminal portion 5*a*, the third terminal portion and the end-of-winding tying portion 5*b* in the case of the second coil terminal 5, so that all portions cannot always be fixed sufficiently, whereby the outside of the first press-fitting projection 21 and the second press-fitting projection 22 are easily affected by vibration and wiring-time fastening.

SUMMARY OF THE INVENTION

It is, accordingly, an object of the present invention to overcome said disadvantages by providing a magnetic coil which does not incur an increase in winding space during winding work and which is compatible with specifications for either a magnetic coil having two coil terminals projecting in only one direction or a magnetic coil having three coil terminals.

Another object of the present invention is to provide a three-terminal type magnetic contactor using a magnetic coil which does not incur an increase in winding space and to provide a compact magnetic contactor of the three-terminal type.

A further object of the present invention is to provide a magnetic coil which is durable against vibration.

DESCRIPTION OF THE PREFERRED EMBODIMENTS

Figure 1:
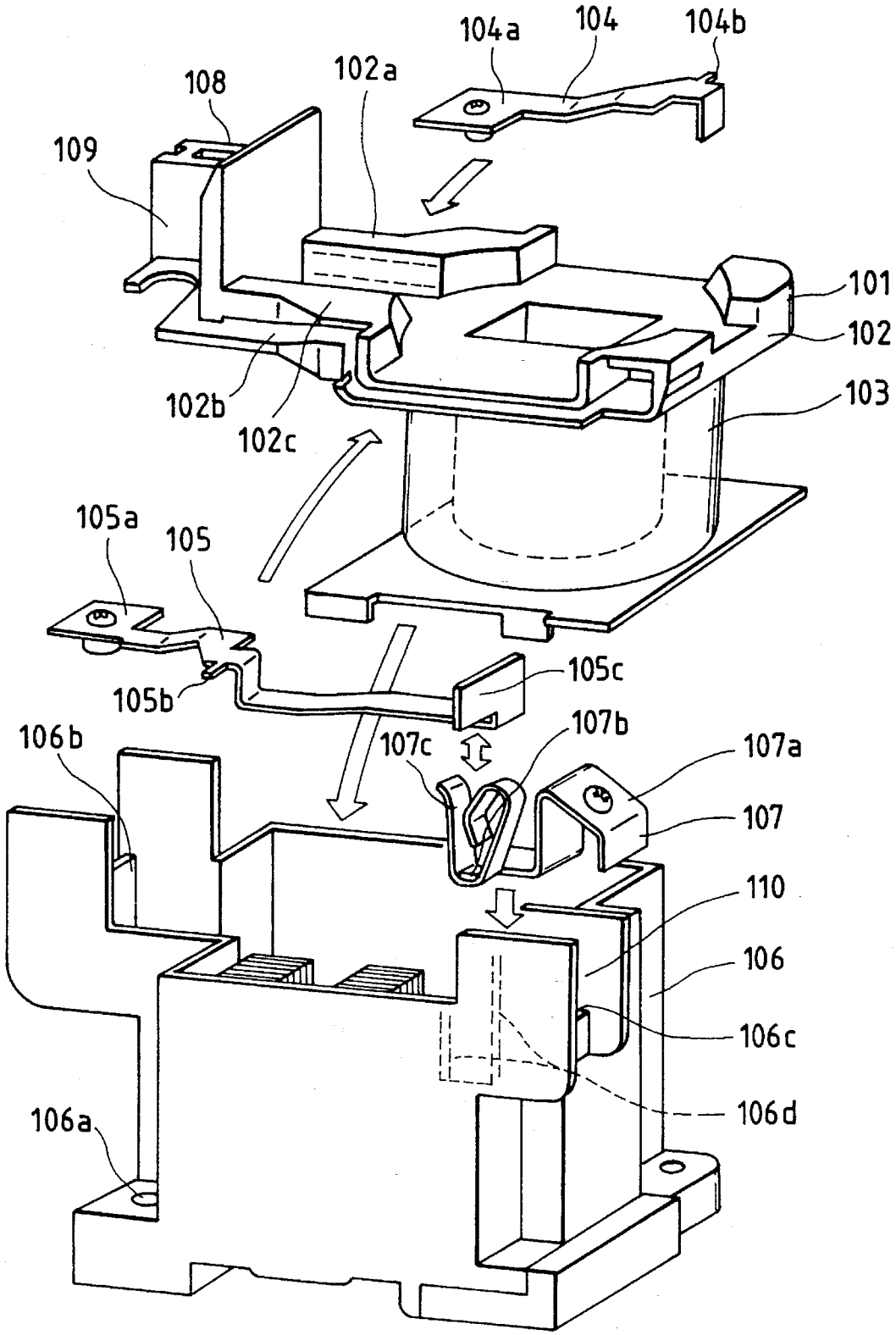
FIG. 1 is an exploded perspective view illustrating the arrangement of a magnetic coil and its peripheral elements in a magnetic contactor which embodies a first embodiment of the present invention.
Figure 2:
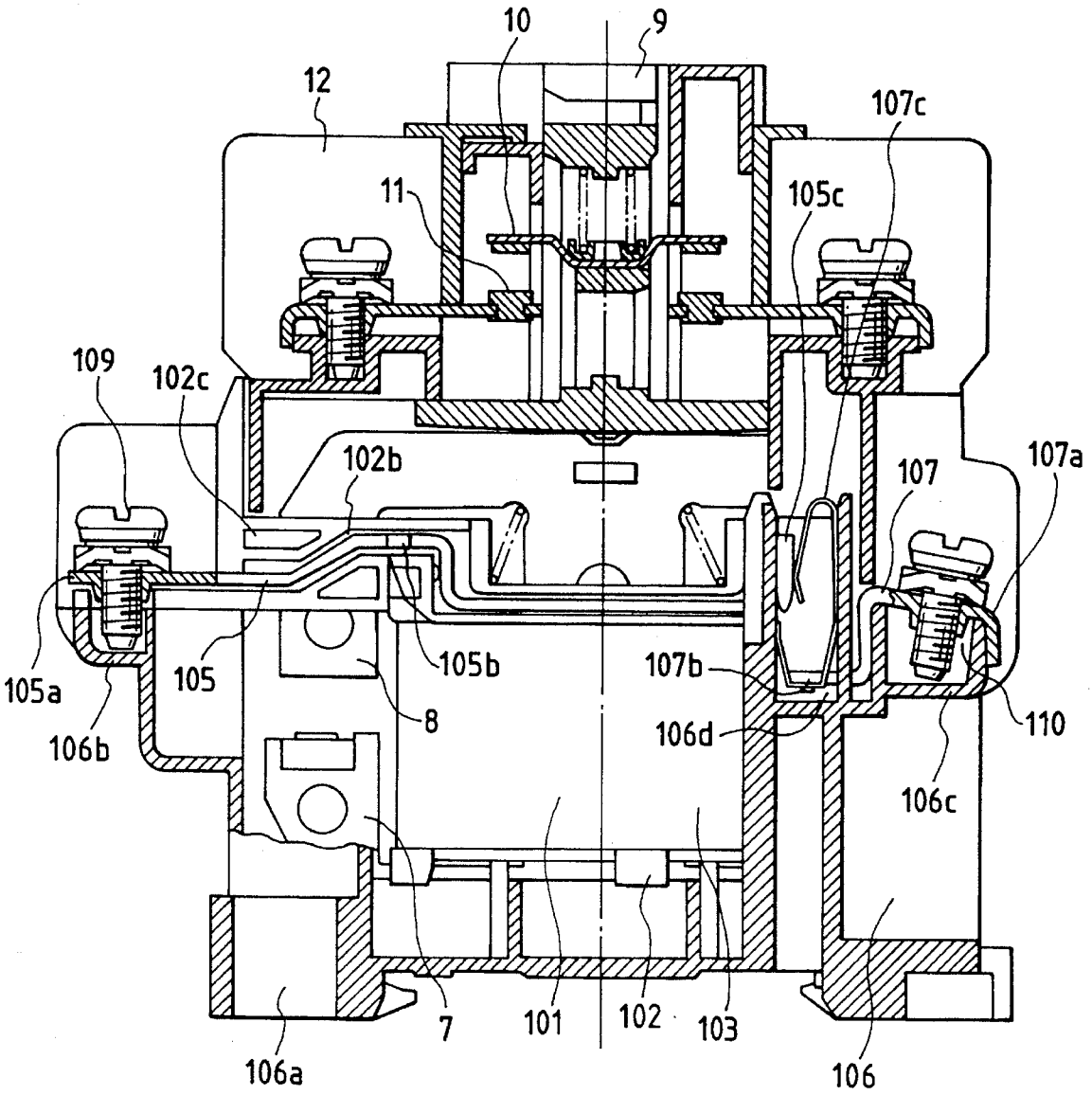
FIG. 2 is a sectional view illustrating the overall arrangement of a magnetic contactor which embodies the first embodiment of the present invention.

A first embodiment of the present invention will now be described in accordance with FIGS. 1 to 4. FIG. 1 is a perspective view showing the arrangement of a magnetic coil in a magnetic contactor which embodies the first embodiment of the present invention, and FIG. 2 is a sectional view showing the overall arrangement of the magnetic contactor in FIG. 1. In these drawings, the numerals 7 to 12 indicate parts identical to those in the arrangement of the conventional magnetic contactor.

As shown in FIG. 1, a magnetic coil 101, a coil frame 102 of the magnetic coil, a first terminal groove 102*a* formed in the coil frame 102, a second terminal groove 102*b* formed opposite to the first terminal groove 102*a*, and terminal support frames 102*c* are formed to extend outwardly so as to be symmetrical with each other relative to the center of the coil frame 102. A winding 103 is provided on the coil frame 102, and a first coil terminal 104 is press-fitted in the first terminal groove 102*a*. A first terminal portion 104*a* is provided at the front end of the first coil terminal 104 and constitutes the external wiring portion of the first coil terminal 104.

As illustrated in FIG. 1, a start-of-winding tying portion 104*b* projects from the side face of the first coil terminal 104. A second coil terminal 105 is disposed opposite to the first coil terminal 104 and is press-fitted in the second terminal groove 102*b*. A second terminal portion 105*a* is provided at the front end of the second coil terminal 105 and is positioned opposite to the first terminal portion 104*a* and constitutes the external wiring portion of the second coil terminal 105.

An end-of-winding tying portion 105*b* projects from the side face of the second coil terminal 105. A terminal piece 105*c* provided at the other end of the second coil terminal 105 is bent in a substantially L shape and projects outwardly from the second terminal groove 102*b* of the coil frame 102 so that the terminal piece 105*c* can be connected with a plate spring 107*c* described later, and constitutes part of a third coil terminal as shown in FIG. 1. This terminal piece 105*c* is also designed such that the projection thereof is located in a cut-out formed at the corner of the coil frame 102.

A case 106 is formed to accommodate the magnetic coil 101, support the bottom surface of the coil frame 102, and cover the terminal support frames 102*c* on both side faces and bottom. Panel installation holes 106*a* are disposed diagonally in the bottom of the case 106, a first terminal supporter 106*b* supports the terminal support frames 102*c*, a second terminal supporter 106*c* is formed on the corner not having the panel installation hole 106*a*. A side wall groove 106*d* is formed in the side face of the case 106 along the second terminal supporter 106*c*, and an external wiring portion 107 is fitted into the second terminal supporter 106*c*, having a terminal surface at a height as shown in FIG. 2, which ranges in part below the plane of the top of the winding 103. External portion 107*a* is approximately as high as the top of the winding 103 of the magnetic coil 101, and constitutes the third coil terminal together with portion 107 and the terminal piece 105*c*, as illustrated in FIG. 1.

As shown in FIGS. 1 and 2, third terminal portion 107*a* is formed at the portion of the external wiring portion 107 fixed by the second terminal supporter 106*c*. A connection 107*b* extends from the third terminal portion 107*a* toward the inside of the case 106, and a plate spring 107*c* which has been formed in a substantially U shape, whose base is fixed to the connection 107*b*, and whose one side is bent at the front end into a V shape so as to return to the inside to provide an elastic effect. This plate spring 107*c*, which is supported by the side wall groove 106*d* constituting a container, is restricted by the inner wall of the side wall groove 106*d* so that the two sides come into contact with each other when the plate spring is supported. One leg runs along the inner wall of said side wall groove 106*d* as shown in FIG. 2, and its front end is contained to engage with the opening wall of the side wall groove 106*d*.

A first terminal block 108 is constituted by the first terminal portion 104*a*, the terminal support frame 102*c* and the first terminal supporter 106*b*. A second terminal block 109 is constituted by the second terminal portion 105*b*, the terminal support frame 102 and the second terminal supporter 106*b*. A third terminal block 110 is constituted by the third terminal portion 107*a* and the second terminal supporter 106*c* as depicted in FIG. 1.

Figure 3:
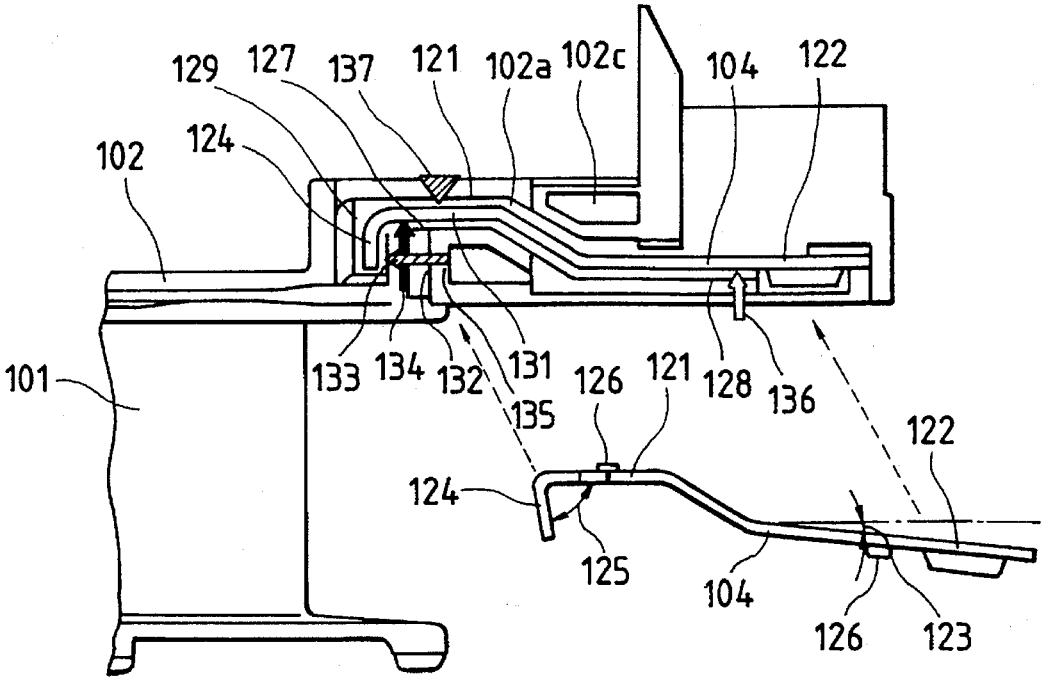
FIG. 3 is a side view of the magnetic coil illustrating the method of fixing a coil terminal in the magnetic contactor in FIG. 1.
Figure 4:
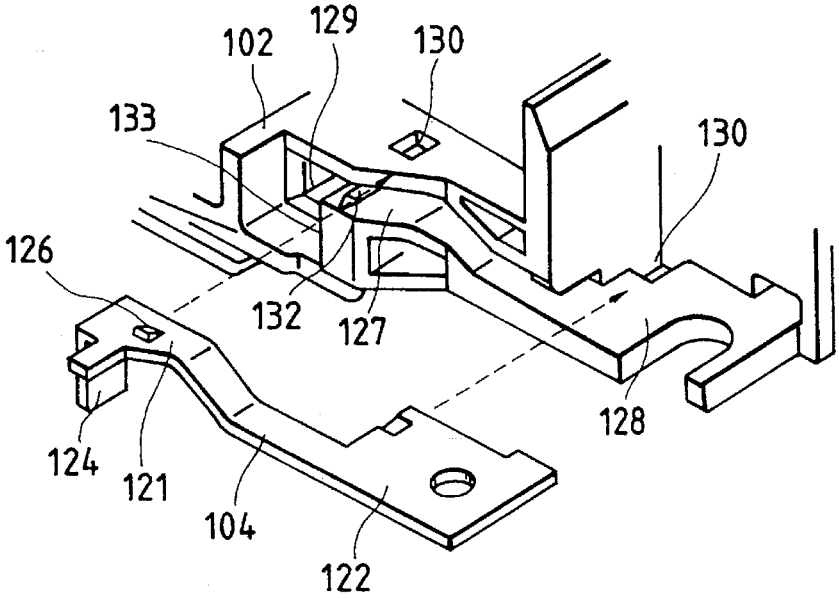
FIG. 4 is a perspective view of the magnetic coil illustrating the details of a coil frame and the coil terminal in the magnetic contactor in FIG. 1.

FIG. 3 is a side view of the magnetic coil showing the coil frame 102, the first coil terminal 104 and the fixing method of the latter in the arrangement of the magnetic contactor in FIG. 1. FIG. 4 is a perspective view of the magnetic coil showing the details of the coil frame 102 and the first coil terminal 104. As shown in these drawings, a middle portion 121 is located in the middle of the first coil terminal 104. A terminal portion 122 extends from the middle portion 121 in the longitudinal direction with a step provided therebetween and front end which is tilted downwardly at the angle of A 123 relative to a plane parallel with the middle portion 121. A press-fitting projection 124 is formed such that one end opposite to the terminal portion 122 has been bent into a substantially L shape, with the middle portion 121 defined as one side, to form the sharp edge of angle B 125. A catch projection 126 is formed on the first coil terminal 104 by extrusion. A middle groove 127 is located in the middle of the first terminal groove 102*a* in the coil frame 102 and into which the middle portion 121 of the first coil terminal 104 is inserted. A terminal receiver 128 is formed in parallel with the middle groove 127 and is constituted only by a bottom surface. A press-fitting groove 129 is formed perpendicularly to the middle groove 127. A catch hole 130 is formed through the top surface of the middle groove 127 and the terminal receiver 128. A first support projection 131 is formed on the top surface of the middle groove 127, a second support projection 132 is formed on the bottom surface of the middle groove 127, and a third support projection 133 is formed on the press-fitting groove 129. Forces 134, 135, 136 work on the first coil terminal 104 when the first support projection 131 is used as a support 137. Force 134 works from the second support projection 132, force 135 works from the third support projection 133, and force 136 works from the terminal receiver 128. It is to be understood that said angle A 123 is designed to be 1° to 5° and angle B 125 is designed to be 85° to 89°.

In the magnetic contactor arranged as described above, the terminal support frames 102*c* and the first terminal supporter 106*b* which constitutes the first terminal block 108 and the second terminal block 109 are shared and disposed at the center of the magnetic contactor, whereby a screwdriver is passed beside the second terminal block 109 and the magnetic contactor is attached perpendicularly when screws are tightened into the panel installation holes 106*a* provided in the bottom surface of the case 106.

Figure 16A:
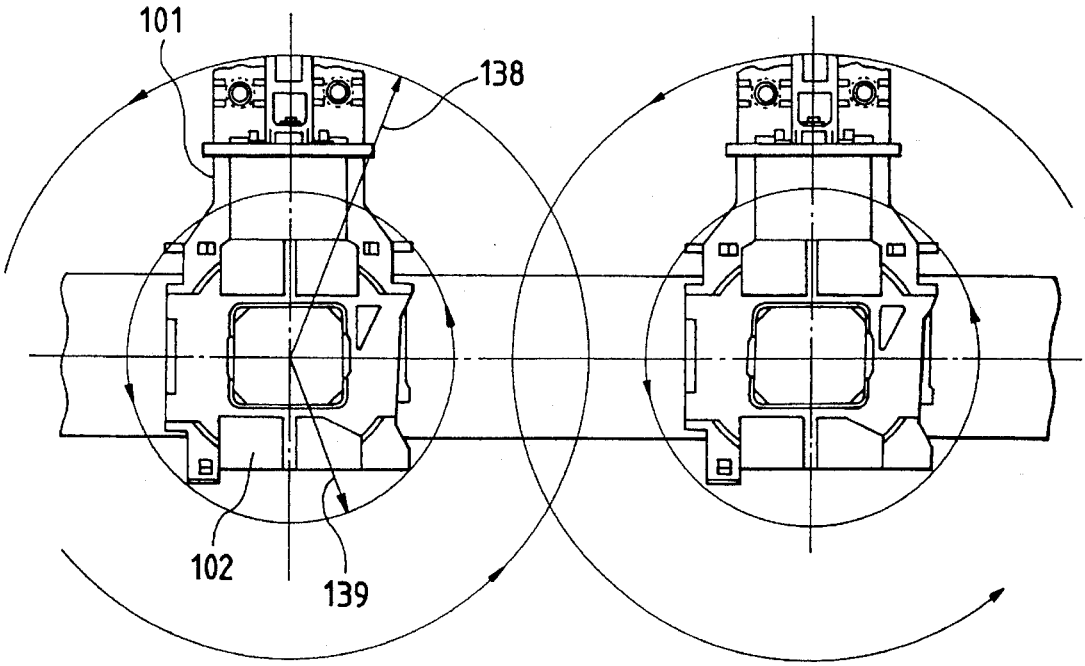
FIGS. 16(*a*) and 16(*b*) show wiring work of the magnetic contactor in FIG. 1.
Figure 16B:
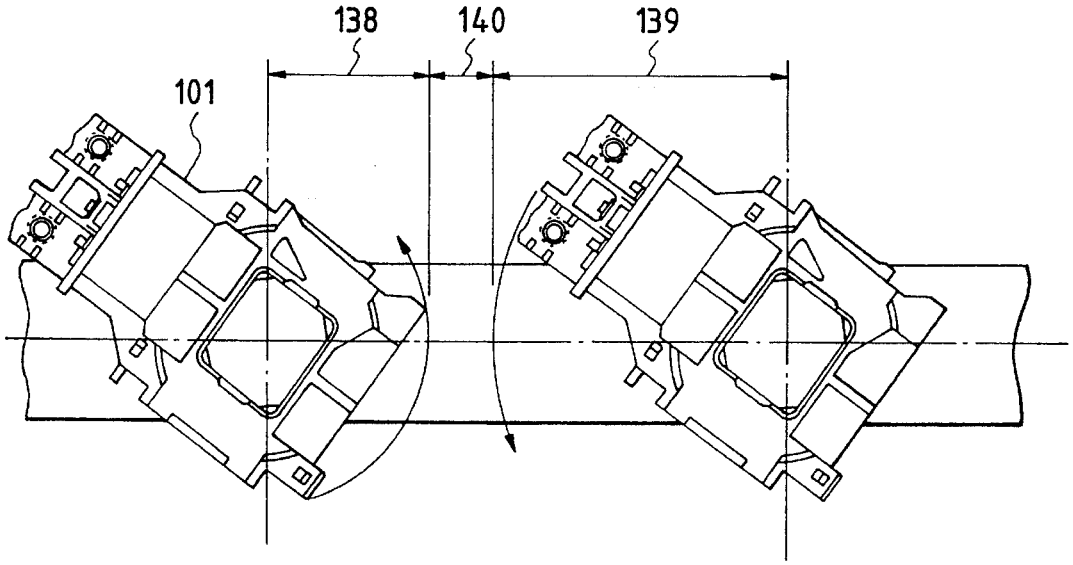
Figure 17A:
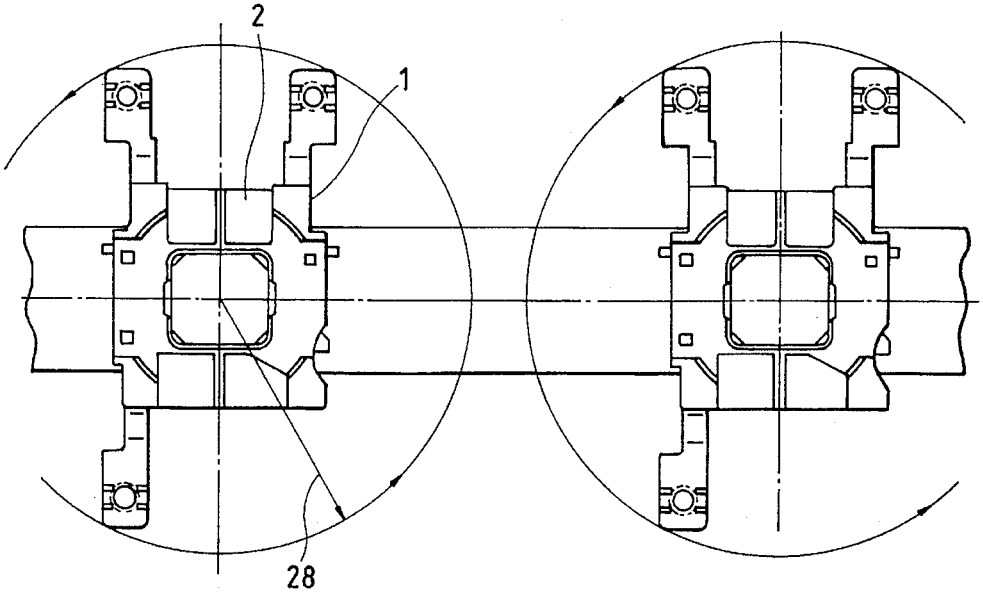
FIGS. 17(*a*) and 17(*b*) show wiring work of the magnetic contactor in FIG. 12.
Figure 17B:
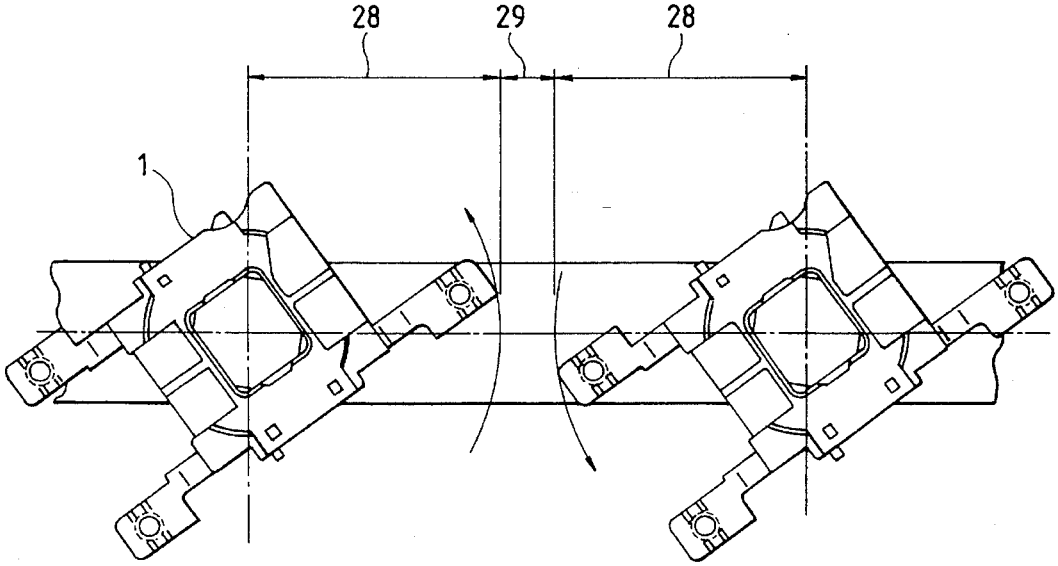
Figure 18:
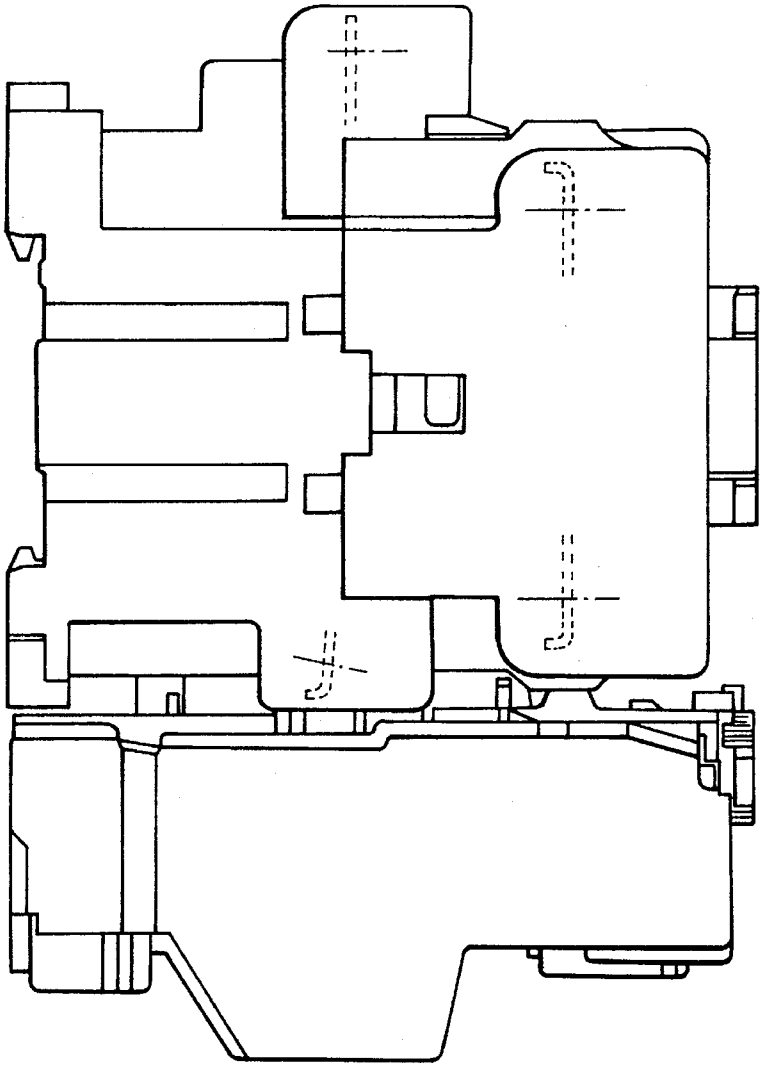
FIG. 18 is a side view of the magnetic contactor provided with a thermal relay illustrating the space between the contactor and the thermal relay.
Figure 19:
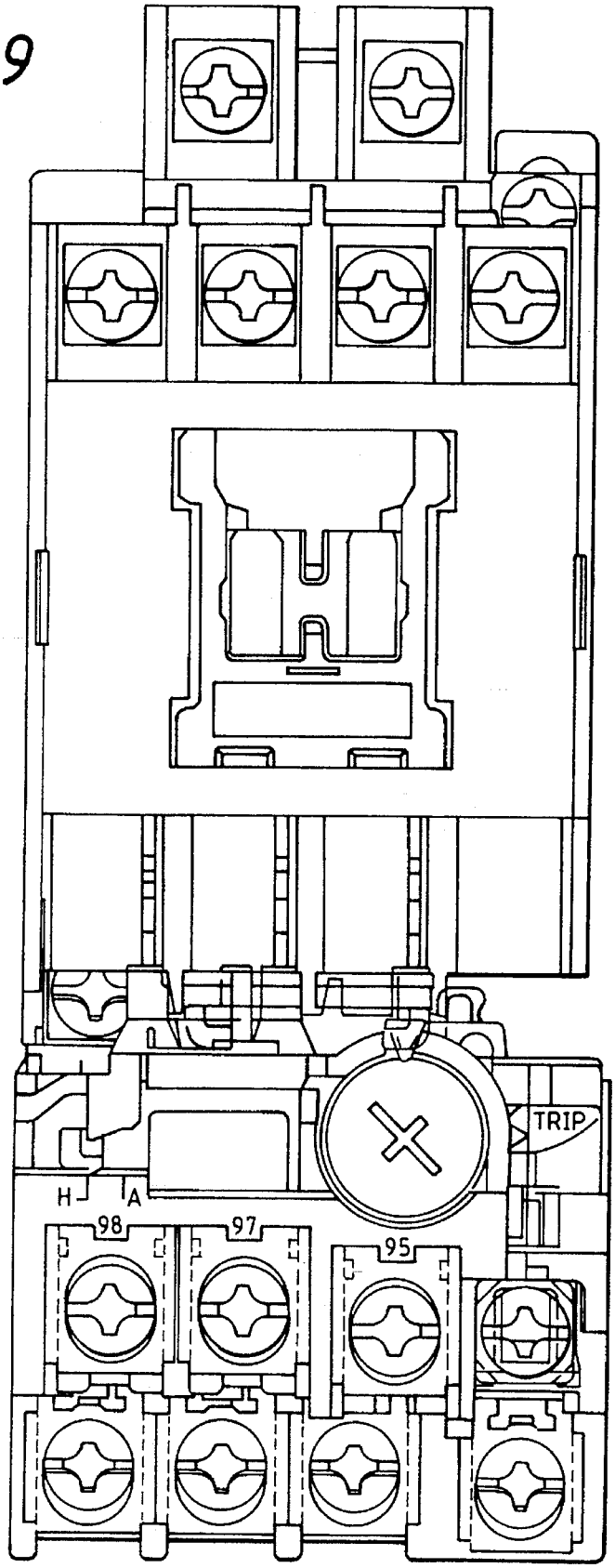
FIG. 19 is a plan view of the magnetic contactor provided with a thermal relay in FIG. 18.

Also, when the magnetic coil 101 is manufactured, the winding work can be done simply by fitting to the coil frame 102 of the magnetic coil 101 the first coil terminal 104 and the second coil terminal 105 integrated with the terminal piece 105*c* constituting part of the third coil terminal. As shown in FIG. 16, each winding shaft of a winder is inserted into the center hole of a coil frame 102 of the magnetic coil 101, and the winding shafts are rotated synchronously to rotate the coil frames 102, thereby winding the magnetic coils 101. The winding shaft-to-winding shaft distance is equal to the value of [(the maximum radius 138)+(the partial radius 139 symmetrical with respect to the radius 138)+(the clearance 140)]. Whereas the magnetic coil is designed as a three-terminal type magnetic coil, winding can be carried out within a winding space equivalent to that of the generally used magnetic coil of which two coil terminals protrude in only one direction.

Also, when three terminal blocks are not required according to the use of the magnetic contactor, the magnetic coil 101 may be used in place of the generally used magnetic coil in which two coil terminals protrude in only one direction.

When the magnetic contactor is assembled, the terminal piece 105*c* formed on the second coil terminal 105 is connected in the moving direction of the movable core 8 with the plate spring 107*c* constituting part of the external wiring portion 107, by fixing the external wiring portion 107 constituting part of the third coil terminal beforehand to the case 106 and placing the magnetic coil 101 (manufactured separately) into the case 106. The terminal piece 105*c* integrated with the second coil terminal 105 is inserted into the center of the substantially U-shaped plate spring 107*c* and the plate spring 107*c* presses the terminal piece 105*c* by its own elasticity to hold the terminal piece therein.

Hence, since the external wiring portion 107 of the third coil terminal is partially assembled independently of the magnetic coil 101 and is connected with the terminal piece 105*c* in the final overall assembly, the location of the third terminal block 110 can be determined independently of the magnetic coil 101, and therefore the third terminal block can be disposed at a considerably lower position so as to satisfy the insulation relationship between the terminal block of the main circuit or the auxiliary circuit located above the third coil terminal block, whereby the magnetic contactor can be reduced in size.

The terminal piece 105*c* is connected with the plate spring 107*c*, which is formed in a U shape, and whose base is fixed to the connection 107*b*. One leg on one side is bent in a V shape to return to the inside at the front end to provide an elastic effect, which is supported in compression such that the two legs on either side make contact with each other in the side wall groove 106*d*, with one leg running along the inner wall of said side wall groove 106*d* as shown in FIG. 2. The front end is contained to engage with the opening wall of side wall groove 106*d*, whereby the terminal piece 105*c* cannot be inadvertently inserted between the plate spring 107*c* and the inner wall of the side wall groove 106*d* and both are electrically connected with excellent contact pressure.

Also, when the plate spring 107*c*, is put into the side wall groove 106*d*, the plate spring 107*c* can be positioned within the side wall groove 106*d* with high accuracy.

Since the terminal piece 105*c* constituting part of the third coil terminal is designed to be connected with the plate spring 107 which is biased in a direction orthogonal to the operation of the movable core 8, the connection reliability is high.

The third terminal consisting of the terminal piece 105*c* and the external wiring portion 107 is provided on the load side of the magnetic contactor, i.e., on the side where a thermal relay is fitted in close contact, whereby when a thermal relay is fitted in close contact beforehand, it is possible to remove beforehand the external wiring portion 107 which becomes unusable at that time.

The method of fixing the first coil terminal 104 will now be described. The terminal portion 122 lowered at the angle of A 123 relative to the middle portion 121 is pushed up by the terminal receiver 128 as soon as the first coil terminal 104 is inserted into the first terminal groove 102*a*. Also, the press-fitting projection 124 formed at the angle of B 125 relative to the middle portion 121 is bent upward along the press-fitting groove 129 formed perpendicularly. This causes the force 135 working from the third support projection 133 and the force 136 working from the terminal receiver 128 to be applied to the first coil terminal 104. These forces balance with each other with respect to the support 137 in terms of moment to fix the first coil terminal. Also, the middle portion 121 is supplementarily secured by the force 134 working from the second support projection 132 to make the start-of-winding tying portion 104*b* more stable. The first coil terminal 104 is held by the engagement of the catch projection 126, which is formed on the surface to which pressure is imposed, and the catch hole 130 to provide firm engagement and does not allow the first coil terminal to be easily removed.

Though not described here, the second coil terminal 105 is also fixed in a similar manner, and further, the terminal piece 105*c* bent in a substantially L shape is bent upward at the same sharp angle as the press-fitting projection 124 to secure the second coil terminal.

Figure 5:
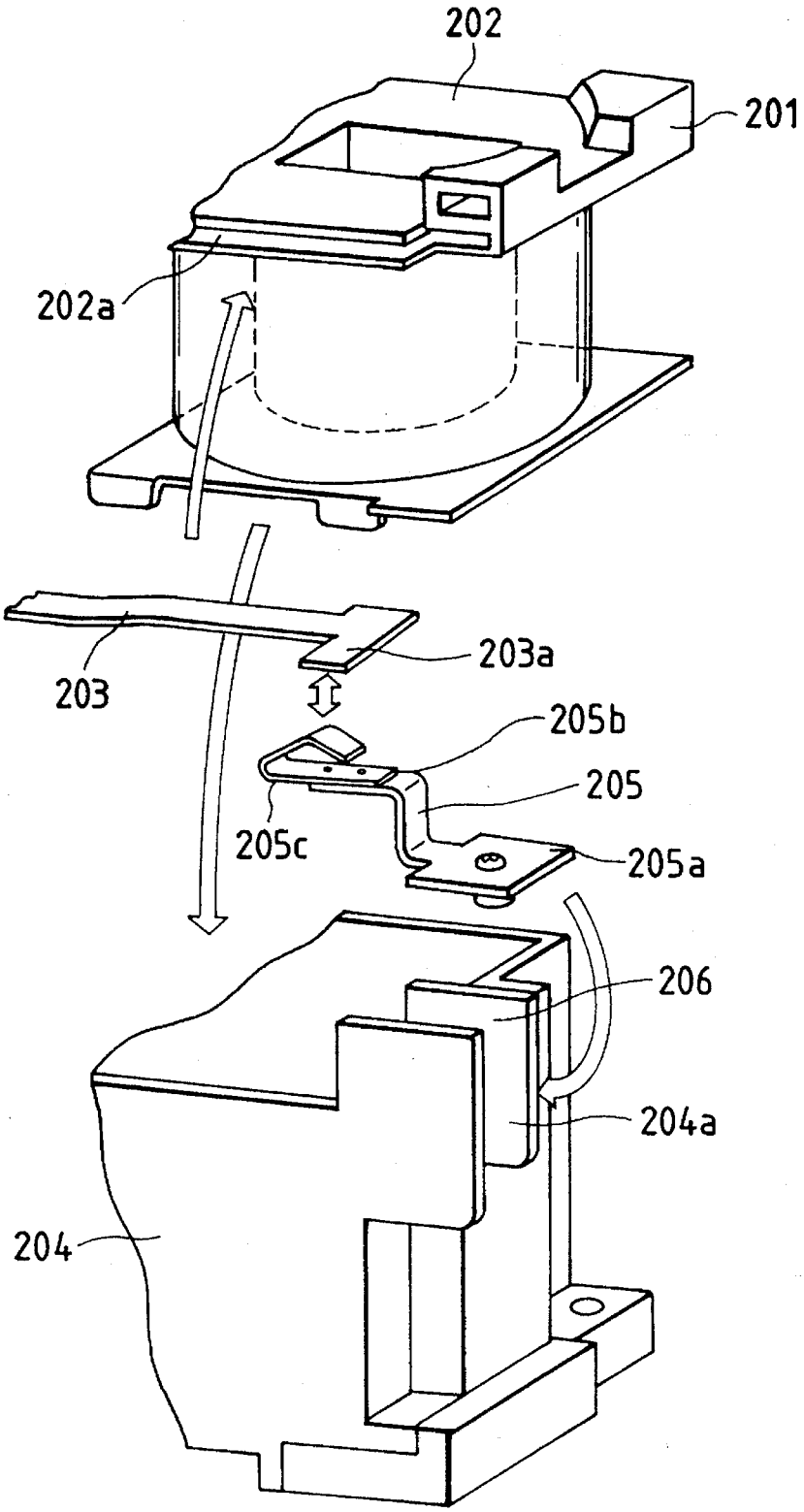
FIG. 5 is an exploded perspective partial view illustrating the arrangement of a magnetic coil in a magnetic contactor which embodies a second embodiment of the present invention.
Figure 6:
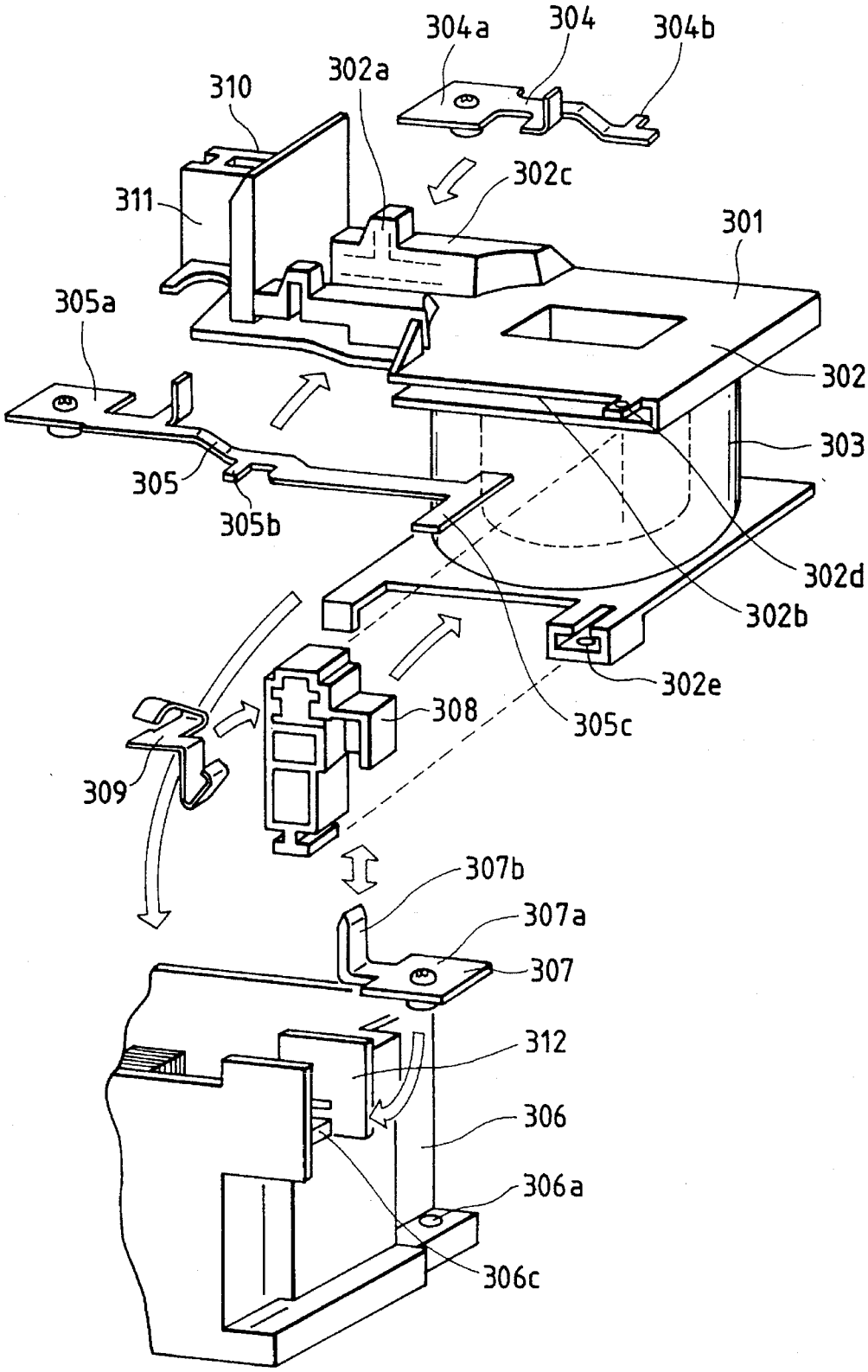
FIG. 6 is an exploded perspective partial view illustrating the arrangement of a magnetic coil in a magnetic contactor which embodies a third embodiment of the present invention.
Figure 7:
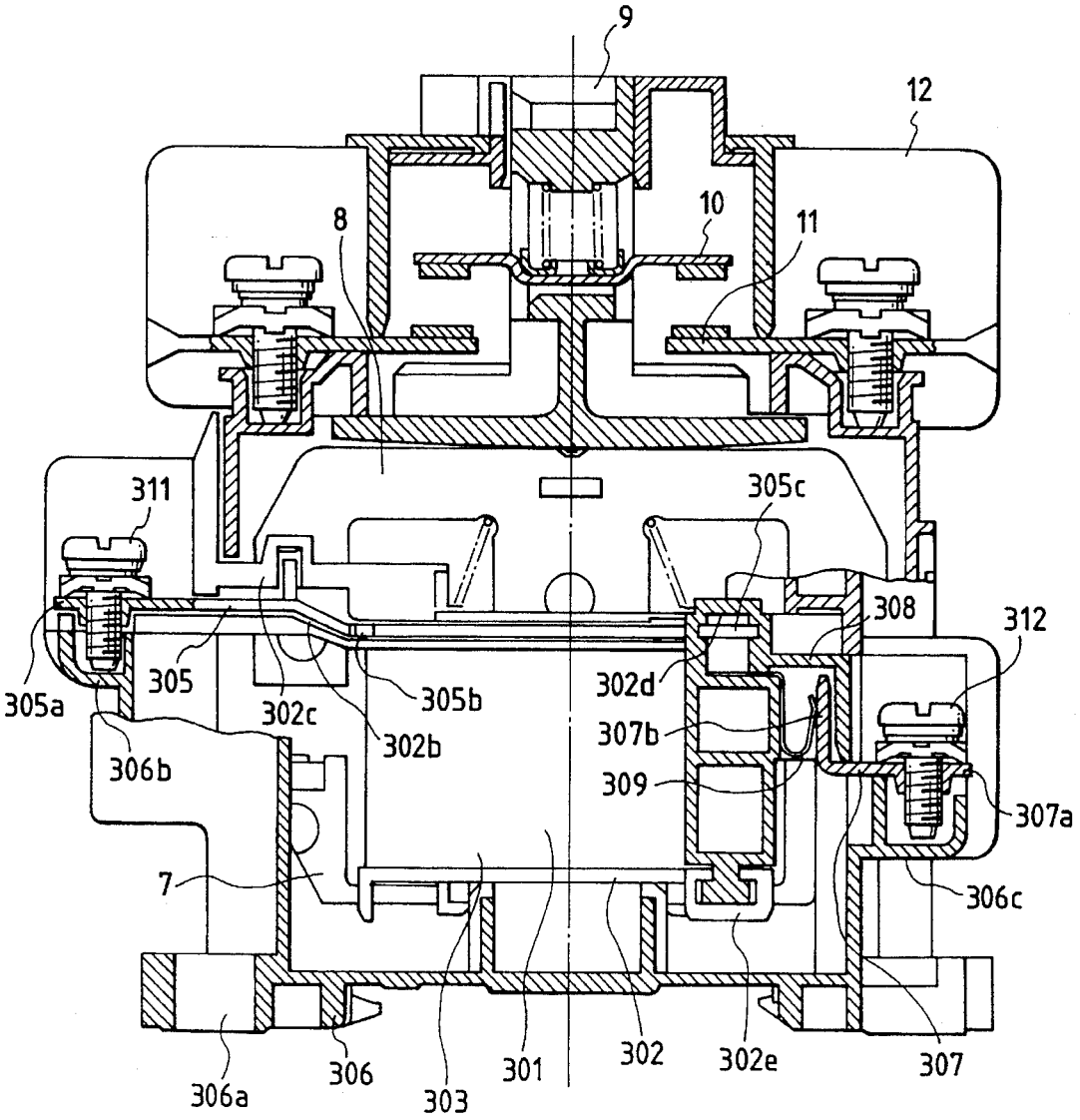
FIG. 7 is a sectional view illustrating an overall arrangement of the magnetic contactor which embodies the third embodiment of the present invention.

A second embodiment of the present invention will now be described in accordance with FIG. 5, which is an exploded perspective view showing the arrangement of a magnetic coil in a magnetic contactor which embodies the second embodiment. As illustrated in FIG. 5, there is a magnetic coil 201, a coil frame 202 of the magnetic coil, a second terminal groove 202*a* formed in the coil frame 202 and a second coil terminal 203 press-fitted into the second terminal groove 202. A terminal piece 203*a* is formed by protruding one end of the second coil terminal 203 outwardly in a substantially L shape and constitutes a third coil terminal along with an external wiring portion mentioned later. This terminal piece 203*a* is also designed such that its projection end is located in a cut-out formed at the corner of the coil frame 202. A case 204 accommodates the magnetic coil 201 and supports the coil frame 202. A second terminal supporter 204*a* is formed at the corner of the case 204, and an external wiring portion 205 is press-fitted into the second terminal 204*a* and constitutes the third coil terminal together with the terminal piece 203*a*.

A third terminal portion 205*a* is formed at the portion of the external wiring portion 205 fixed by the second terminal supporter 204*a*. A connection 205*b* extends from the third terminal portion 205*a* toward the inside of the case 204. A plate spring 205*c* has been bent into a V shape to provide an elastic effect and has one end fixed to the connection 205*b*. A third terminal block 206 is constituted by the third terminal portion 205*a* and the second terminal supporter 204*c*. The parts not shown are identical to those in Embodiment 1 in FIG. 1.

In the magnetic contactor arranged as described above, after the second coil terminal 203 integrated with the terminal piece 203*a* constituting part of the third coil terminal is fitted to the coil frame 202 as in Embodiment 1 in FIG. 1, winding is done, and subsequently the magnetic coil 201 is assembled into the case 204 which has been fitted beforehand with the external wiring portion 205 of the third coil terminal. At this time, the external wiring portion 205 of the third coil terminal is connected with the terminal piece 203*a* via the plate spring 205*c*. Also, the plate spring 205*c* is pressed elastically by the pressure of assembling the magnetic coil 201 to completely hold the connection with the terminal piece 203*a*. The present embodiment also provides the same effects as Embodiment 1.

Figure 12:
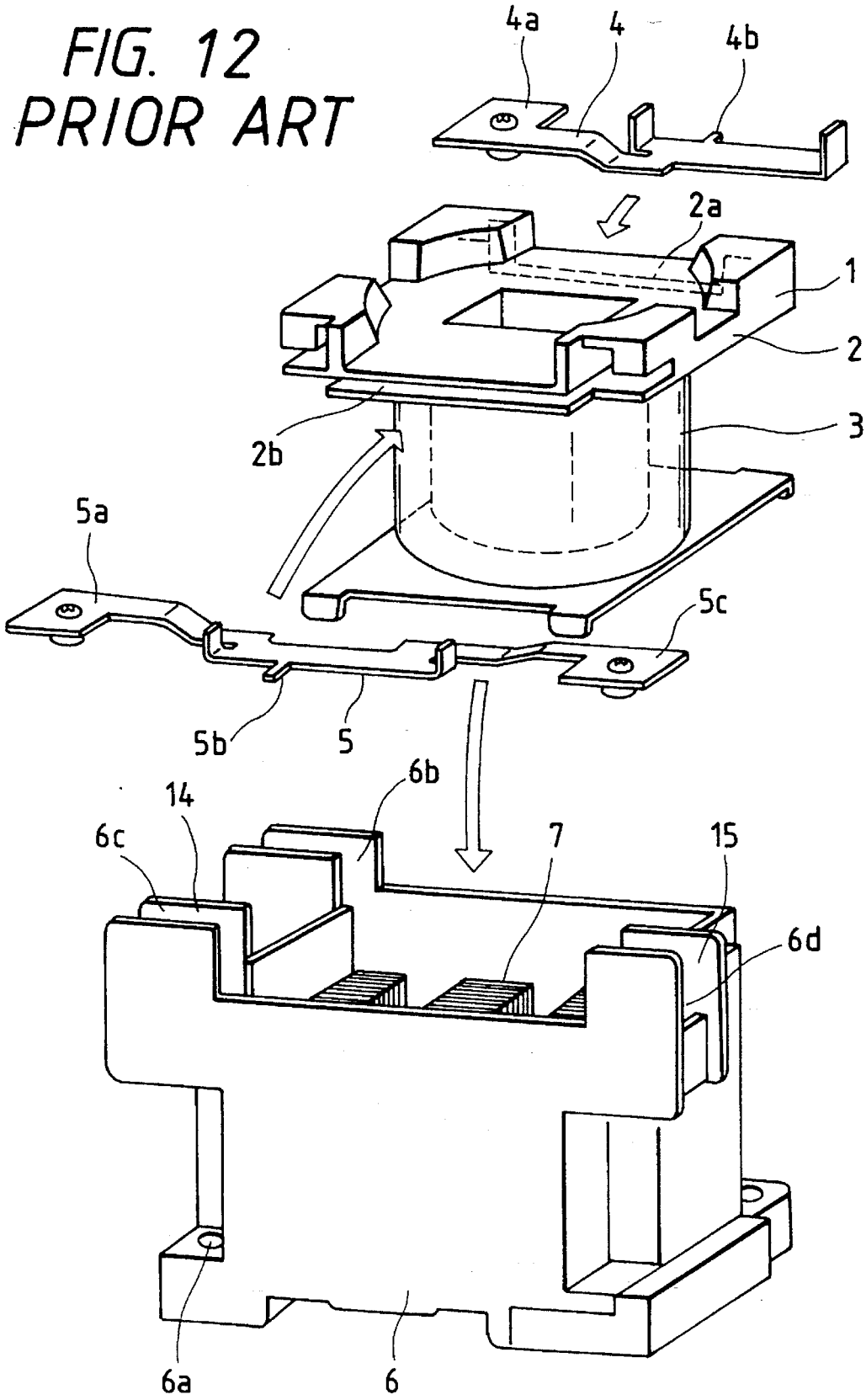
FIG. 12 PRIOR ART
FIG. 12 is an exploded perspective view illustrating the arrangement of a magnetic coil in a magnetic contactor which embodies the conventional art.
Figure 13:
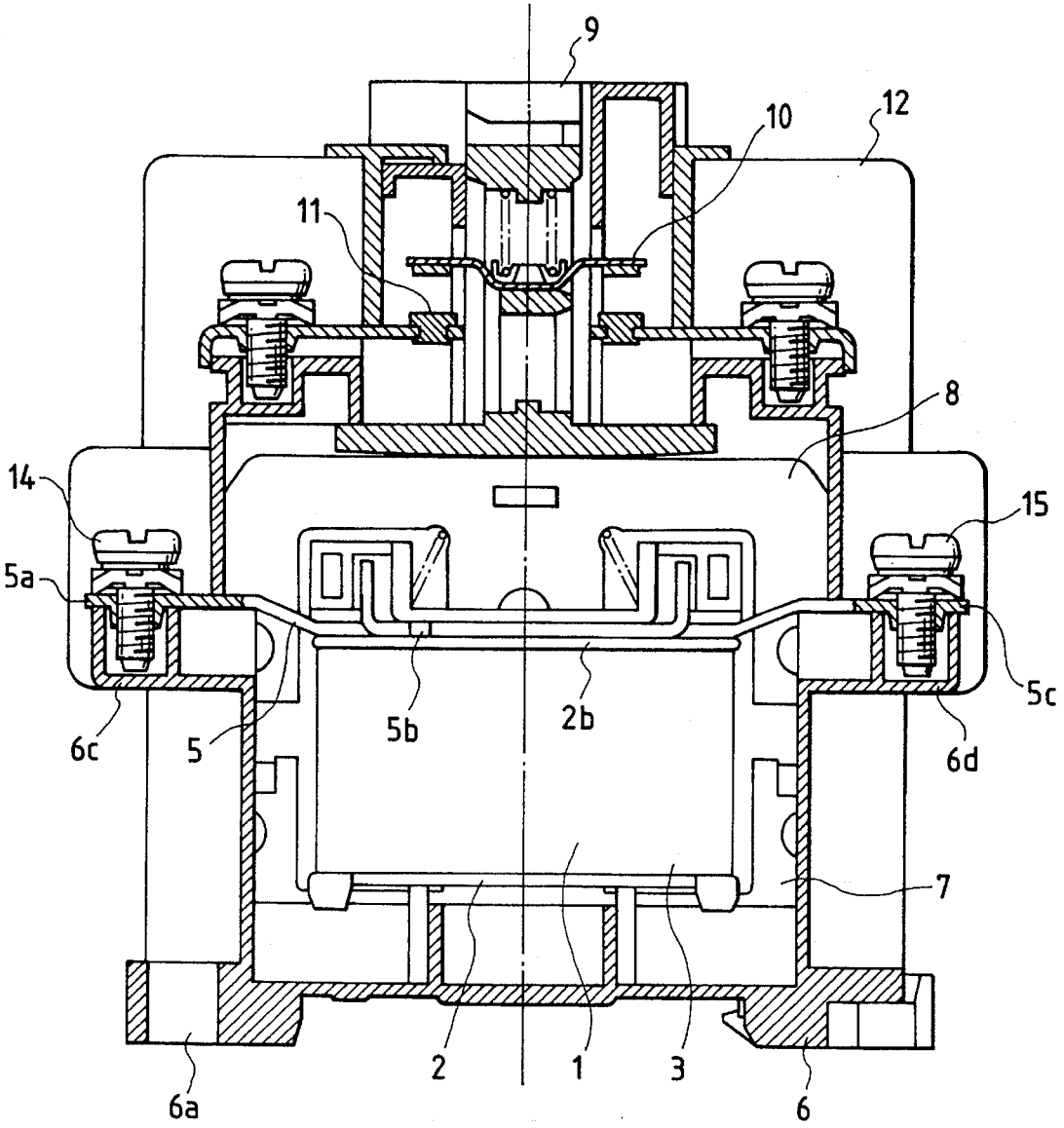
FIG. 13 PRIOR ART
FIG. 13 is a sectional view illustrating an overall arrangement of the magnetic contactor which embodies the conventional art.
Figure 14:
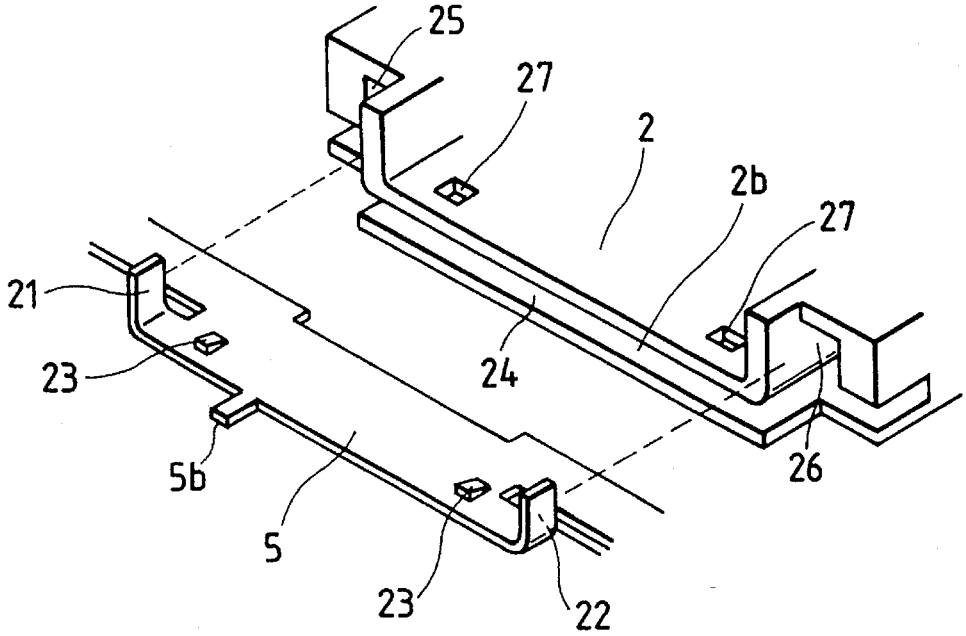
FIG. 14 PRIOR ART
FIG. 14 is an exploded perspective view of the magnetic coil illustrating the details of a coil frame and a coil terminal in the magnetic contactor in FIG. 12 which embodies the conventional art.
Figure 15:
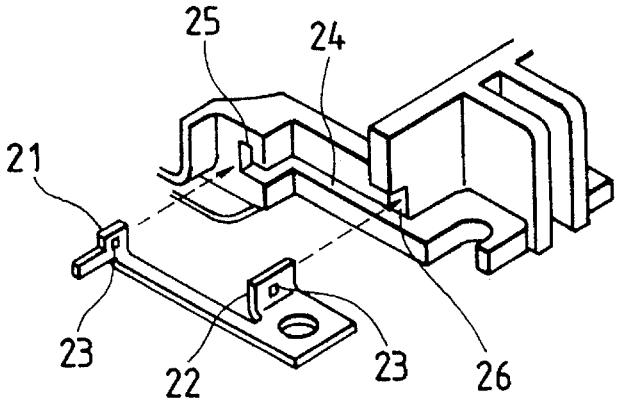
FIG. 15 PRIOR ART
FIG. 15 is an exploded perspective view of the magnetic coil illustrating the details of a coil frame and a coil terminal in another magnetic contactor which embodies the conventional art.

A third embodiment of the present invention will now be described as shown in FIGS. 6–9. In these drawings, the numerals 7 to 12 indicate parts identical to those in the arrangement of the conventional magnetic contactor as shown in FIGS. 12–13. The third embodiment has a magnetic coil 301, a coil frame 302 of the magnetic coil, a first terminal groove 302*a* formed in the coil frame 302, a second terminal groove 302*b* formed opposite to the first terminal groove 302*a*, terminal support frames 302*c* which extend outwardly so as to be symmetrical with each other relative to the center of the coil frame 302 and integrated with each other at the front end. A fitting projection 302*d* protrudes from an upper thin plate of the coil frame 302. A fitting groove 302*e* is opposed to the fitting projection 302*d* and formed on a block projecting from the coil frame 302. A winding 303 is provided on the coil frame 302 and a first coil terminal 304 is press-fitted in the first terminal groove 302*a*. A first terminal portion 304*a* is provided at the front end of the first coil terminal 304 and constitutes the external wiring portion of the first coil terminal 304.

A start-of-winding tying portion 304*b* projects from the side face of the first coil terminal 304. A second coil terminal 305 is disposed opposite to the first coil terminal 304 and is press-fitted in the second terminal groove 302*b*. A second terminal portion 305*a* is provided at the front end of the second coil terminal 305 and is positioned opposite to the first terminal portion 304*a*, and constitutes the external wiring portion of the second coil terminal 305. An end-of-winding tying portion 305*b* projects from the side face of the second coil terminal 305, and a terminal piece 305*c* is provided at the other end of the second coil terminal 305, projecting outwardly from the second terminal groove 302*b* of the coil frame 302 so that it can be connected with a plate spring 309 described later, and constitutes part of a third coil terminal. This terminal piece 305*c* is also designed such that the projection end thereof is located in a cut-out formed at the corner of the coil frame 302.

A case 306 is formed to accommodate the magnetic coil 301, support the bottom surface of the coil frame 302, and cover the terminal support frames 302*c* at both side faces and bottom. Panel installation holes 306*a* are disposed diagonally in the bottom of the case 306. A first terminal supporter supports the terminal support frames 302*c* and a second terminal supporter 306*c* is formed on the corner not having the panel installation hole 306*a*. An external wiring portion 307 is press-fitted into the second terminal supporter 306*c* and has a terminal surface at a height within the range in which the winding 303 of the magnetic coil 301 is wound, and constitutes the third coil terminal along with a joint mentioned later and the terminal piece 305*c*.

A third terminal portion 307*a* is formed at the portion of the external wiring portion 307 fixed by the second terminal supporter 306*c*. An inserting portion 307*b* is bent upward into a substantially L shape from the third terminal portion 307*a* and chamfered at the front end. A joint frame 308 fitted onto the fitting projection 302*d* and into the fitting groove 302*e* of the coil frame 302 is bridged across the flanges of the coil frame 302 and has grooves where a plate spring 309*c*, mentioned later, both sides of the terminal piece 305*c*, the fitting projection 302*d* and the inserting portion 307*b* formed on the external wiring portion 307 are inserted. A plate spring 309 is fitted along a groove formed in the joint frame 308 so as to be totally covered by said joint frame 308, and is bent into a substantially L shape to make contact with both the terminal piece 305*c* of the third coil terminal and the inserting portion 307*b* of the external wiring portion 307 Contact portions are bent into a V shape to provide an elastic effect. The plate spring 309 constitutes a joint together with the joint frame 308. The portion brought into contact with the terminal piece 305*c* of the third coil terminal is bent such that the elastic force works in the same direction as the moving direction of the movable core, and the portion brought into contact with the inserting portion 307*b* of the external wiring portion 307 is bent such that the elastic force works in the direction orthogonal to the moving direction of the movable core.

A first terminal block 310 is constituted by the first terminal portion 304*a*, the terminal support frame 302*c* and the first terminal supporter 306*b*. A second terminal block 311 is constituted by the second terminal portion 305*b*, the terminal support frame 302*c* and the first terminal supporter 306*b*. A third terminal block 312 is constituted by the third terminal portion 307*a* and the second terminal supporter 306*c*.

Figure 9:
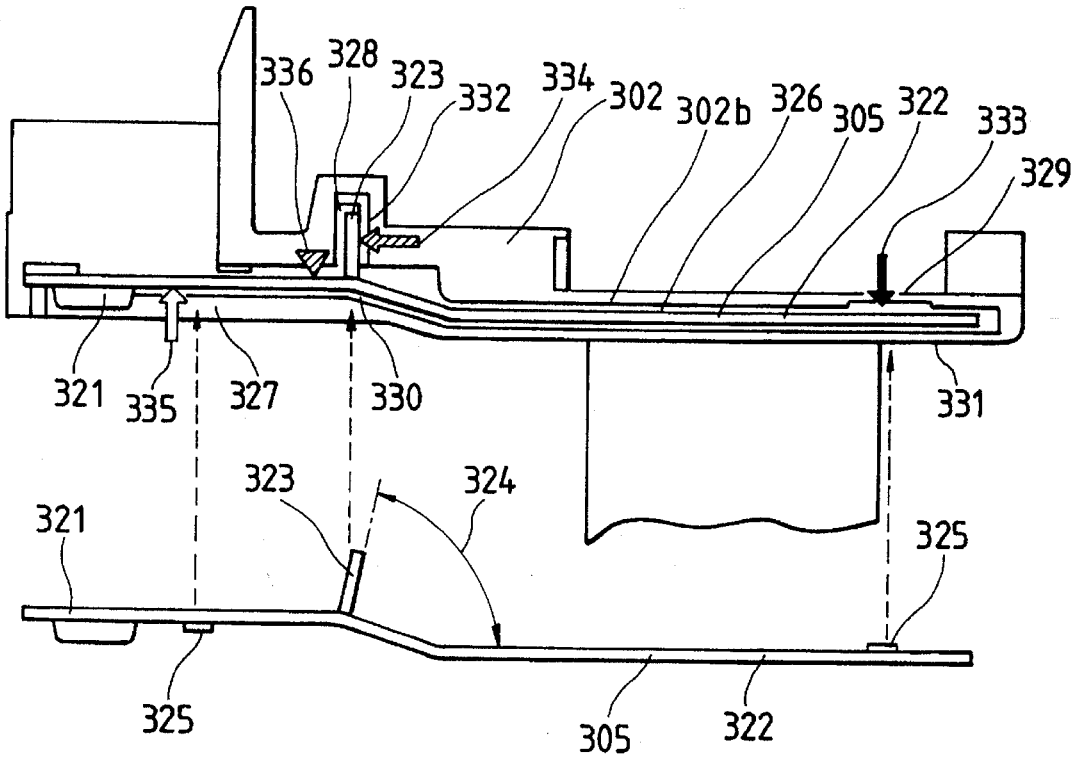
FIG. 9 is a side view of the magnetic coil illustrating the method of fixing a coil terminal in the magnetic contactor in FIG. 6.
Figure 9:
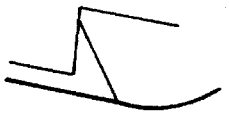

As shown in FIG. 9, a terminal portion 321 is formed at one end of the second coil terminal 305, and a cross portion 322 extends from the terminal portion 321 in the longitudinal direction with a step provided therebetween and is formed at the other end of the second coil terminal 305. A press-fitting projection 323 is designed such that the center of the second coil terminal 305 has been cut and bent into a substantially L shape to form a sharp angle of C 324 with a plane parallel with the cross portion 322. A catch projection 325 is formed at the second coil terminal 305 by extrusion. A cross groove 326 forms substantially half of the second terminal groove 302*b* in the coil frame 302, into which the cross portion 322 of the second coil terminal 305 is inserted. A terminal receiver 327 is formed in parallel with the cross groove 326 and is constituted only by a bottom surface.

A press-fitting groove 328 is formed perpendicular to a step provided between itself and the cross groove 326. A catch hole 329 is formed through the top surface of the cross groove 326 and the terminal receiver 327. A first support projection 330 is formed on a portion of a surface perpendicular to the press-fitting groove 328 and adjacent the press-fitting groove 328. A second support projection 331 is formed on the top surface of the cross groove 326 and a third support projection 326 is formed on the press-fitting groove 328. Forces 333, 334, 335 work on the second coil terminal 305 when the first support projection 330 is used as a support 336. A force 333 works from the second support projection 331, another force 334 works from the third support projection 332, and still another force 335 works from the terminal receiver 327. It is to be understood that said angle C 324 is designed to be between 85° to 90°.

The magnetic contactor arranged as described above is assembled in the following manner. Namely, the first coil terminal 304 and the second coil terminal 305 integrated with the terminal piece 305*c* constituting part of the third coil terminal are fitted to the coil frame 302 and winding work is carried out to manufacture the magnetic coil 301 beforehand. Then, the joint frame 308 accommodating the plate spring 309 is fitted into the coil frame 302 of said manufactured magnetic coil 301 to connect the terminal piece 305*c* and the plate spring 309. Specifically, the fitting projection 302*d* of the coil frame 302 is inserted into the groove of the joint frame 308, both sides of the terminal piece 305*c* are inserted into the groove of the joint frame 308 so as to be located under the fitting projection 302*d*, and the engagement portion formed at the bottom end of the joint frame 308 is fitted into the fitting groove 302*e*. When the joint frame 308 is fitted to the coil frame 302 as described above, the joint frame 308 is bridged across the flanges of the coil frame 302 to mechanically reinforce the coil frame 302, whereby the coil frame 302 can be prevented from being deformed and/or damaged if mechanical stress is applied to the coil frame 302.

Also, both sides of the terminal piece 305*c* are inserted into the groove of the joint frame 308 to mechanically position said terminal piece 305*c* and the plate spring 309 bent to work elastic force in the same direction as the moving direction of the movable core 8 is positioned under the terminal piece 305*c* by the groove of the joint frame 308, whereby the fitting projection 302*d* of the coil frame 302 is located above the plate spring 309 and also the plate spring 309 and the terminal piece 305*c* make a very reliable electrical connection. Also, at this time, since the fitting projection 302*d* of the coil frame 302 is engaged with the groove of the joint frame 308, the electrical connection of the plate spring 309 and the terminal piece 305*c* is maintained even if subjected to mechanical vibration.

When the fitting of the joint frame 308 is complete, the magnetic coil 301 is contained in the case 306. When the inserting portion 307*b* of the external wiring portion 307 fixed beforehand to the case 306 is inserted into the groove of the joint frame 308 in the moving direction of the movable core 8, the plate spring 309 presses the inserting portion 307*b* of the external wiring portion 307 by its own elasticity, which works in the direction orthogonal to the moving direction of the movable core 8, to connect the terminal piece 305*c* and the external wiring portion 307 via the plate spring 309. At this time, the inserting portion 307*b* of the external wiring portion 307 constituting part of the third coil terminal is designed to be connected with the plate spring 309 which works in the direction orthogonal to the movement of the movable core 8, ensuring high connection reliability.

Finally, when the housing 12 where contacts and the like have been assembled is fitted, the assembly of the magnetic contactor is complete. At this time, since the housing 12 is fitted such that the external wiring portion 307 is pressed by the opening end face of the housing 12 via the connection portion of the inserting portion 307*b* of the external wiring portion 307 and the plate spring 309, the mechanical fixture of the external wiring portion 307 is firm, and in addition, if the external wiring portion 307 is fixed below the opening end face of the case 306, part of the housing 12 need not be extended because of that pressure, whereby the shape of the housing 12 is simplified.

Figure 8:
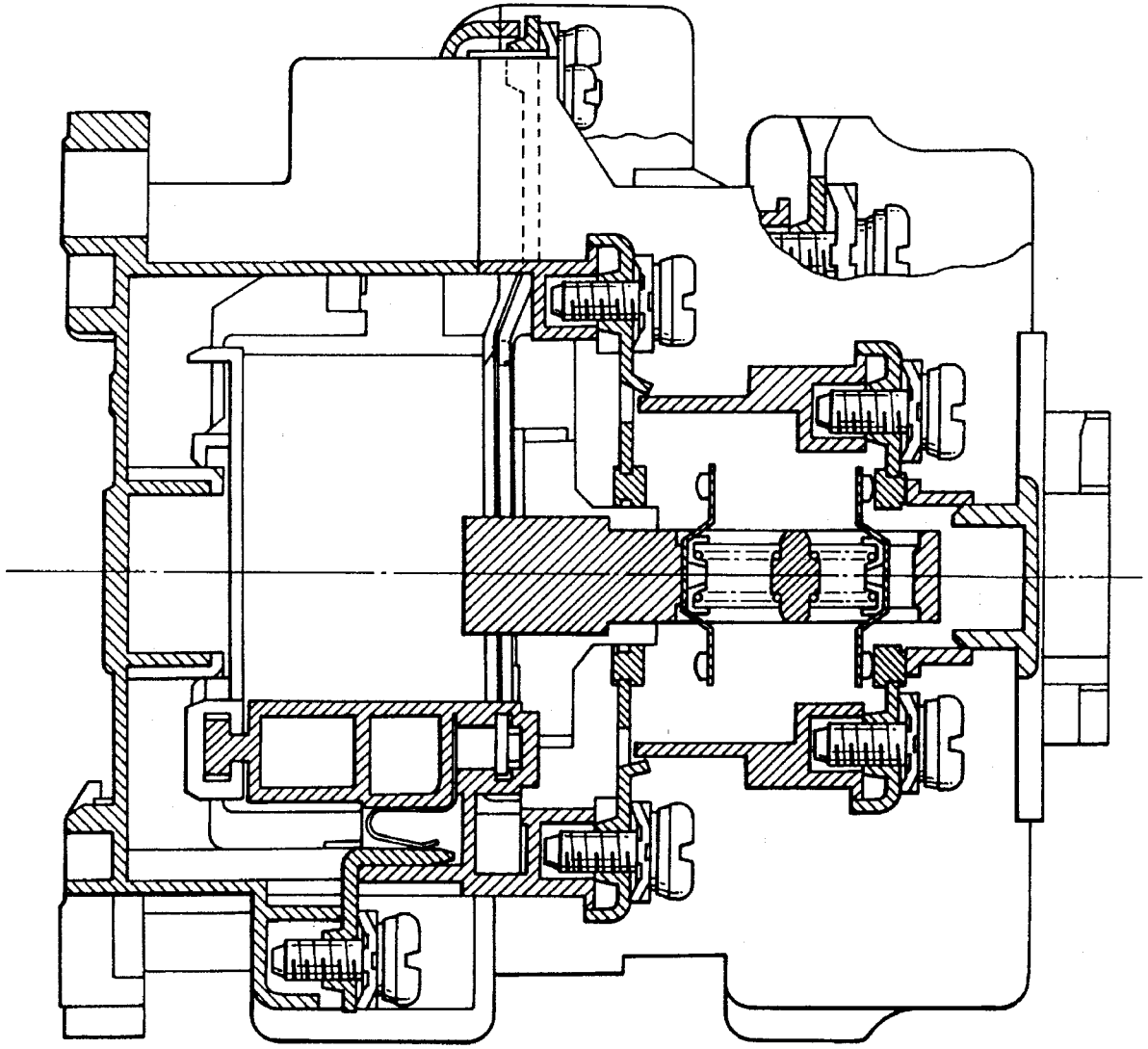
FIG. 8 is a sectional view from a position different from that of FIG. 7 of the magnetic contactor which embodies the third embodiment of the present invention.

Also, in the magnetic contactor designed as described above, the terminal piece 305*c* and the external wiring portion 307 are connected by the plate spring 309 which is practically covered with the joint frame 308, whereby if the external wiring portion 307 constituting part of the third coil terminal is adjacent to the terminal block of a main or auxiliary circuit located above as shown in FIG. 8, the insulation relationship between them can be fully satisfied and the magnetic contactor can be made more compact than those in Embodiment 1 or 2. It is to be understood that the present embodiment produces identical effects to those of Embodiment 1.

Also, the present embodiment, designed such that the joint is located on the third coil terminal side in the above description, may be arranged such that said joint is employed on the first and second coil terminal side when the manufactured magnetic coil will not be used as a general magnetic coil from which only two terminal coils project only in one direction.

The method of fixing the second coil terminal 305 will now be described. First, the terminal portion 321 and the cross portion 322 formed in parallel with each other can be inserted comparatively easily into to the terminal receiver 327 and the cross groove 326 which are formed similarly in parallel with each other. At this time, the press-fitting projection 323 is easily inserted into the press-fitting groove 328 but when the press-fitting projection 323 rides on the third support projection 324, the press-fitting projection 323 formed to have the sharp angle of C 324 is bent upward perpendicularly and is imparted the force 334 which works from the third support projection 323. Since the second coil terminal 305 attempts to return to its original shape by its own elasticity, a moment is generated using the first support projection 330 as the support 336 and the second coil terminal 305 is given counterforces in the form of the force 333 which works from the second support projection 331 and the force 335 which works from the terminal receiver 327. The above balance of forces causes the second coil terminal 305 to be fixed inside the second terminal groove 302*b* of the coil frame 302. Also, since the second coil terminal 305 is held by the engagement of the catch projection 325, which is formed on the surface to which pressure is applied and the catch hole 329, the engagement is so firm that the second coil terminal 305 cannot easily be removed. The terminal portion 321, the end-of-winding portion 305*b* and the terminal piece 305*c* are directly fixed immediately nearby, whereby they are stably fitted.

Figure 10:
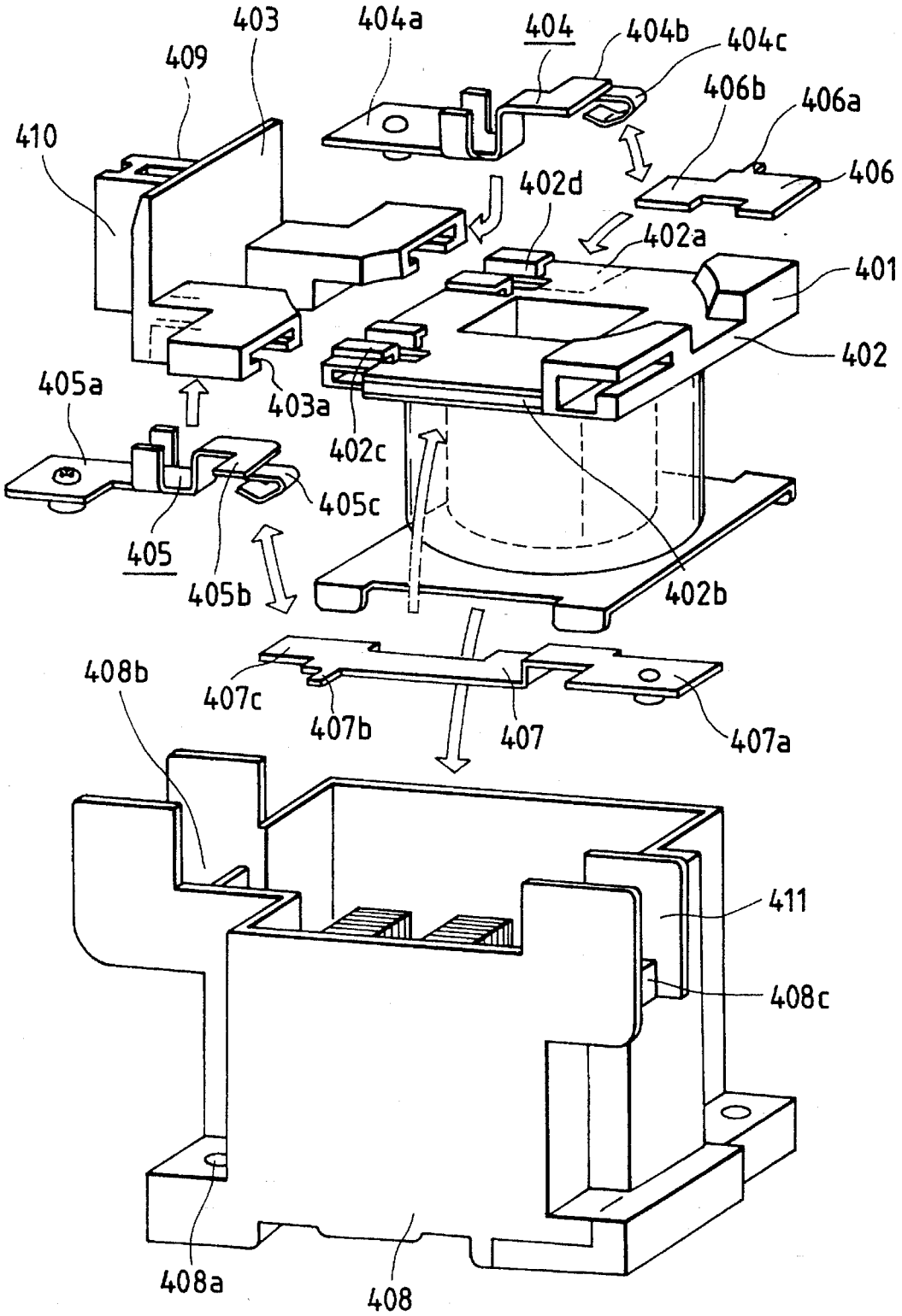
FIG. 10 is an exploded perspective view illustrating the arrangement of a magnetic coil in a magnetic contactor which embodies a fourth embodiment of the present invention.

A fourth embodiment of the present invention will now be described in accordance with FIG. 10. As illustrated in FIG. 10, there exists a magnetic coil 401, and a coil frame 402 of the magnetic coil. A first terminal groove 402*a* is formed in the coil frame 402 and a second terminal groove 402*b* is formed opposite to the first terminal groove 402*a*. Union projections 402*c* are formed above the first terminal groove 402*a* and the second terminal groove 402*b* and have symmetrically sufficiently spaced rails. Union windows 402*d* are cut along the rails between the rails of the union projections 402*c*. A terminal support frame 403 having two arm-shaped hollow portions formed symmetrically is shown. Union grooves 403*a* are formed in the two front ends of the terminal support frame 403 and a first external wiring portion 404 is press-fitted into the terminal support frame 403 and constitutes part of a first coil terminal together with a first terminal piece 406 mentioned later. A first terminal portion 404*a* is provided at the front end of the first external wiring portion 404 and a first connection 404*b* extends from the first terminal portion 404*a* with a step provided therebetween. A first plate spring 404*c* is fixed to the first connection 404*b*. A second external wiring portion 405 disposed opposite to the first external wiring portion 404 press-fitted into the terminal support frame 403, and constitutes part of a second coil terminal along with a second terminal piece 407 described later. A second terminal portion 405*a* is provided at the front end of the second wiring portion 405. A second connection 405*b* extends from the second terminal portion 405*a* with a step provided therebetween. A second plate spring 405*c* is fixed to the second connection 405*b*. A first terminal piece 406 is press-fitted into the first terminal groove 402*a* of the coil frame 402. A start-of-winding tying portion 406*a* projects from the side face of the first terminal piece 406. A first connection portion 406*b* is located at one end of the first terminal piece 406. A second terminal piece 407 is press-fitted into the second terminal groove 402*b* of the coil frame 402. A third terminal 407*a* is provided at the front end of the second terminal piece 407. An end-of-winding tying portion 407*b* projects from the side face of the second terminal piece 407. A second connection portion 407*c* is located at the other end of the second terminal piece 407. A case 408 is formed to accommodate the magnetic coil 401, support the bottom surface of the coil frame 402 and also the terminal support frame 403, and cover the terminal support frame 403 an both side faces and bottom. Panel installation holes 408*a* are disposed diagonally in the bottom of the case 408. A first terminal supporter 408*b* supports the terminal support frame 403 and a second terminal supporter 408*c* is formed on the corner not having the panel installation hole 408*a*. A first terminal block 409 is constituted by the first terminal portion 404*a*, the terminal support frame 403 and the first terminal supporter 408*b*. A second terminal block 410 is constituted by the second terminal portion 405*b*, the terminal support frame 403 and the first terminal supporter 408*b*. A third terminal block 411 is constituted by the third terminal 407*a* and the second terminal supporter 408*c*. It is to be understood that the first terminal piece 406 and the second terminal piece 407 are designed to be practically contained in the flanges of the coil frame 402.

When the magnetic coil 401 is assembled, the first terminal piece 406 and the second terminal piece 407 are first fitted to the coil frame 402 and winding is completed. Then, the coil frame 402 and the terminal support frame 403 into which the first external wiring portion 404 and the second external wiring portion 405 have been press-fitted beforehand are engaged by the union projections 402*c* and the union grooves 403. The first terminal piece 406 and the first external wiring portion 404 are connected by the first plate spring 404*c* and the second terminal piece 407 and the second external wiring portion 405 are connected by the second plate spring 405*c* through the union windows 402*d*. After the coil frame 402 and the terminal support frame 403 are put into the case 408, the case 408 supports them so that they are fixed as a stable union. The first external wiring portion 404 and the second external wiring portion 405 are partially assembled independently of the magnetic coil 401, and are connected after the winding work, whereby the locations of the first terminal block 409 and the second terminal block 410 are determined independently of the magnetic coil 401. The present embodiment has the same effects as Embodiment 1.

Figure 11:
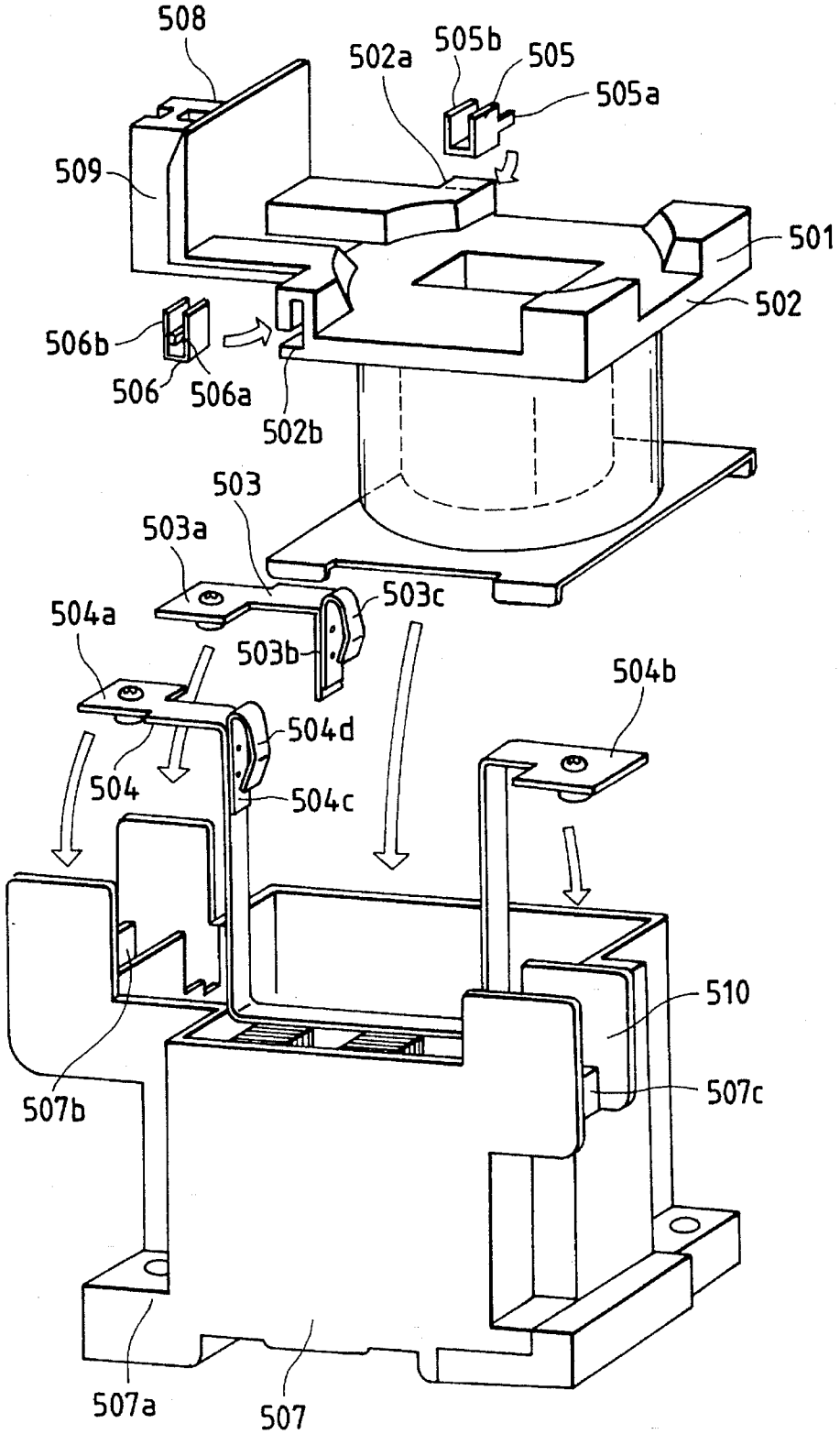
FIG. 11 is an exploded perspective view illustrating the arrangement of a magnetic coil in a magnetic contactor which embodies a fifth embodiment of the present invention.

A fifth embodiment of the present invention will now be described in accordance with FIG. 11. As illustrated in FIG. 11, there is a magnetic coil 501, and a coil frame 502 of the magnetic coil. A first terminal groove 502*a* is formed in the coil frame 502 and a second terminal groove 502*b* is formed opposite to the first terminal groove 502*a*. A first external wiring portion 503 is formed in a substantially L shape and constitutes a first coil terminal together with a first terminal piece 505 mentioned later. A first terminal portion 503 is provided at the front end of the first external wiring portion 503. A first connection 503*b* extends from the first terminal portion 503*a* with the substantially L-shaped portion provided therebetween. A first plate spring 503*c* is fixed to the first connection 503*b*. A second external wiring portion 504 is formed in a substantially U shape, of which both ends are bent to form a substantially L shape and constitutes a second coil terminal along with a second terminal piece 506 described later. A second terminal portion 504*a* is provided at one end of the second wiring portion 504. A third terminal 504*b* is provided at the other end of the second external wiring portion 504. A second connection 504*c* extends from the second terminal portion 504*a* with the substantially L-shaped portion provided therebetween. A second plate spring 504*d* is fixed to the second connection 504*c*. A first terminal piece 505 is press-fitted into the first terminal groove 502*a* of the coil frame 502. A start-of-winding tying portion 505*a* projects from the side face of the first terminal piece 505. A first connection portion 505*b* is formed opposite the first plate spring 503*c*. A second terminal piece 506 is press-fitted into the second terminal groove 502*b* of the coil frame 502. An end-of-winding tying portion 506*a* projects from the side face of the second terminal piece 506. A second connection portion 506*b* is formed opposite the second plate spring 504*d*. A case 507 is formed to accommodate the magnetic coil 501 and support the bottom surface of the coil frame 502. Panel installation holes 507*a* are disposed diagonally in the bottom of the case 507. A first terminal supporter 507*b* secures the first terminal portion 503*a* and the second terminal portion 504*a*. A second terminal supporter 507*c* secures the third terminal portion 504*b*. A first terminal block 508 is constituted by the first terminal portion 503*a*, the coil frame 502 and the first terminal supporter 507*b*. A second terminal block 509 is constituted by the second terminal portion 504*a*, the coil frame 502 and the first terminal supporter 507*b*. A third terminal block 510 is constituted by the third terminal 504*b* and the second terminal supporter 507*c*. It is to be understood that the first terminal piece 505 and the second terminal piece 506 are designed to be practically contained in the flanges of the coil frame 502.

When the magnetic coil 501 is assembled, the first terminal piece 505 and the second terminal piece 506 are first fitted to the coil frame 502 and winding is completed. The first external wiring portion 503 and the second external wiring portion 504 integrated with the third coil terminal 504*b* are press-fitted directly into the case 507 and secured at a position where the magnetic coil 501 is avoided. As soon as the magnetic coil 501 is contained in the case 507, the first plate spring 503*c* and the second plate spring 504*c* disposed symmetrically with each other on the side faces of the case 507 and fixed facing the inside of the case 507 are connected with the first terminal piece 505 and the second terminal piece 506. The first external wiring portion 503 and the second external wiring portion 504 are partially assembled independently of the magnetic coil 501 and are connected after the winding procedure, whereby the locations of all of the terminal blocks are determined independently of the magnetic coil 501.

It will be apparent that the invention, as described above, achieves a magnetic coil which does not increase the winding space needed and which is compatible with the specification of either a magnetic coil from which two coil terminals protrude in one direction and a magnetic coil having three coil terminals.

The magnetic contactor allows a third coil terminal block to be disposed in considerably lower position in order to satisfy the insulation relationship with the terminal block of a main or auxiliary circuit which is located above, whereby the size of the magnetic contactor can be reduced even though it is of the three-terminal type.

It will also be apparent that the invention achieves a magnetic contactor which ensures high reliability of the connection between the terminal piece of a third coil terminal and an external wiring portion, in addition to the above effects.

It will also be apparent that the invention achieves a magnetic contactor in which the terminal piece cannot be inserted between an elastic portion and the inner wall of a container, and which ensures high reliability connection between the terminal piece of a third coil terminal and an external wiring portion and allows the elastic portion to be contained in the container with high accuracy, in addition to the above effects.

It will also be apparent that the invention achieves a magnetic contactor which maintains the electrical connection between a conductive piece and a terminal piece extremely reliably even if subjected to mechanical vibration.

It will also be apparent that the invention achieves a magnetic contactor which can prevent a coil frame from being deformed and/or damaged if mechanical stress is applied to the coil frame.

It will also be apparent that the invention achieves a magnetic contactor in which the mechanical fixture of an external wiring portion is firm, and if the external wiring portion is located below the opening end face of a case, part of the housing need not be extended and the housing shape is simplified.

It will also be apparent that the invention achieves a magnetic contactor in which the external wiring portion of a third coil terminal that cannot be used when a thermal relay is fitted beforehand in close contact can be removed beforehand from the magnetic contactor.

It will also be apparent that the invention achieves a magnetic contactor in which the winding space of a magnetic coil is equivalent to that of a magnetic coil where only two coil terminals are used, and a method of manufacturing a magnetic coil which provides a magnetic coil having terminals durable against mechanical vibration.

What is claimed is:

1. A magnetic coil unit, comprising;

a coil frame, a winding wound around said coil frame, a first coil terminal connected with one end of the winding and connectible with external wiring, a second coil terminal connected with another end of the winding and connectible with external wiring said first and second coil terminals being secured to flanges of the coil frame so that the first coil terminal and the second coil terminal extend in the same direction outwardly from the flanges of the coil frame, and a terminal piece connected freely disconnectibly with an external wiring portion extending from one of said first or second coil terminals in a direction opposite to the direction of said first or second coil terminal, connection between said external wiring portion and said terminal piece being substantially contained in a flange of the coil frame.

2. A magnetic contactor, comprising;

a magnetic coil wound with a winding about a coil frame, a case for containing said magnetic coil, a first coil terminal connected with one end of the winding and connectible with external wiring and a second coil terminal connected with another end of the winding and connectible with external wiring being disposed on one side of said case, a third coil terminal connected with said one end or said other end of the magnetic coil and connectible with external wiring, and being disposed on another side opposite to said one side of the case, said first and second coil terminals being secured to the coil frame of the magnetic coil, said third coil terminal including a terminal piece extending from the first or second coil terminal and an external wiring portion, said terminal piece being secured to a flange of the coil frame of said magnetic coil, and said external wiring portion being secured to said case, said terminal piece and external wiring portion being connected freely disconnectibly.

3. The magnetic contactor as defined in claim 2, wherein the terminal piece of the third coil terminal is made of a plate-shaped material and is bent such that a plate surface direction of the connection of said terminal piece with the external wiring portion is the same as a moving direction of a movable core of said contactor, the external wiring portion being constituted by a substantially U-shaped elastic portion connected with the terminal piece and a portion connected with the external wiring, and a container for accommodating the elastic portion of the external wiring portion provided in the case to accommodate the elastic portion of said external wiring portion so that the elastic portion is restricted to bring both ends of the substantially U shaped elastic portion into contact with each other, the terminal piece being connected freely disconnectibly in the moving direction of the movable core.

4. The magnetic contactor as defined in claim 2, wherein the terminal piece of the third coil terminal is made of a plate-shaped material and is bent such that a plate surface direction of the connection of said terminal piece with the external wiring portion is the same as a moving direction of a movable core of said contactor, the external wiring portion including an elastic portion a container for accommodating the elastic portion of the external wiring portion being provided in the case to accommodate the elastic portion of said external wiring portion so that the elastic portion is restricted to bring portions thereof into contact with each other, one part of said elastic portion running along an inner wall of said container and a front end thereof engaging with an opening wall of said container, said terminal piece being connected freely disconnectibly in the moving direction of the movable core.

5. A magnetic contactor, comprising;

a magnetic coil wound with a winding around a coil frame, and a case for containing said magnetic coil, a first coil terminal connected with one end of the winding and connectible with external wiring and a second coil terminal connected with another end of the winding and connectible with external wiring disposed on one side of said case, and a third coil terminal connected with an end of the winding and connectible with external wiring, and disposed on a side opposite said one side of the case, said first and second coil terminals being secured to the coil frame, said third coil terminal including a terminal piece extending from the first or second coil terminal, an external wiring portion, a joint for joining said terminal piece and the external wiring portion, said terminal piece being secured to the coil frame of said magnetic coil, said external wiring portion being secured to said case, said joint comprising an insulating joint frame and a conductive piece disposed substantially within said joint frame, and said terminal piece and said external wiring portion being connected by said conductive piece.

6. The magnetic contactor as defined in claim 5, wherein the insulating joint frame is coupled with flanges of the coil frame.

7. The magnetic contactor as defined in claim 5, wherein the insulating joint frame is positioned between flanges on sides of the coil frame, and ends of the joint frame being coupled with the respective flanges of the coil frame.

8. The magnetic contactor as defined in claim 5, wherein the conductive piece is elastic, one end of said conductive piece being bent to produce an elastic force working in a moving direction of a movable core of said contactor and being disposed in a position corresponding to a connection location with the terminal piece, another end of the conductive piece being bent to produce an elastic force working in a direction orthogonal to the moving direction of the movable core and being disposed in a position corresponding to a connection location with the external wiring portion, said terminal piece being inserted into the insulating joint frame in a direction orthogonal to the moving direction of the movable core and being connected with the conductive piece, the connection of the external wiring portion with the conductive piece being inserted into the joint frame in the moving direction of the movable core.

9. The magnetic contactor as defined in claim 5, wherein the conductive piece of the joint is elastic, a groove receiving said terminal piece being provided in the insulating joint frame of the joint, one end of said conductive piece being bent such that an elastic force thereof works in a moving direction of a movable core of said contactor, said conductive piece being disposed under said groove so that the bent portion of said one end of said conductive piece makes contact with the terminal piece, another end of the conductive piece being bent such that elastic force works in a direction orthogonal to the moving direction of the movable core and being disposed under said groove so that the bent portion of said other end of said conductive piece makes contact with the external wiring portion, said terminal piece being inserted into the insulating joint frame in a direction orthogonal to the moving direction of the movable core and connected with the conductive piece, the connection of the external wiring portion with the conductive piece being inserted into the insulating joint frame in the moving direction of the movable core and connected with the conductive piece.

10. The magnetic contactor as defined in claim 5, wherein the external wiring portion is pressed by a housing covering an opening of a magnetic equipment case via the connection of the external wiring portion and the conductive piece in the joint frame.

11. The magnetic contactor as defined in claim 2, wherein the third coil terminal is disposed at a location where a thermal relay is disposed.

12. The magnetic contactor as defined in claim 2, wherein the connection of the terminal piece with the external wiring portion is secured such that it is substantially contained in the flange of the coil frame.

13. A magnetic coil unit, comprising;

a coil frame, a winding wound around said coil frame, a first coil terminal connected with one end of the winding and provided on a flange of the coil frame so as to extend outwardly from the flange of the coil frame, a second coil terminal connected with another end of the winding and provided on the flange of the coil frame so as to extend outwardly in the same direction as the first coil terminal from the flange of the coil frame, and a third coil terminal extending from the first or second coil terminal in a direction opposite to the extending direction of said first or second coil terminal, said first coil terminal comprising a first external wiring portion connected to external wiring and a first terminal piece connected with one end of the winding and secured to the coil frame so that the connection thereof with said external wiring portion is substantially contained in the flange of the Y coil frame, said second coil terminal being constituted by a second external wiring portion connected to external wiring and a second terminal piece connected with another end of the winding and secured to the coil frame so that a connection thereof with said external wiring portion is substantially contained in the flange of the coil frame, the external wiring portions of the first and second coil terminals being freely disconnectibly coupled with respective terminal pieces of the first and second coil terminals.

14. A magnetic contactor, comprising;

a magnetic coil wound with a winding around a coil frame, and a case for containing said magnetic coil, a first coil terminal connected with one end of the winding and connectible with external wiring, a second coil terminal connected with another end of the winding and connectible with external wiring, said first and second coil terminals being disposed on one side of said case, a third coil terminal connected with said one end or said another end of the winding and connectible with external wiring, and disposed on another side opposite to the one side of the case where the first and second coil terminals are disposed, said first coil terminal comprising a first terminal piece connected with said one end of the winding and secured to the coil frame so as to be substantially contained in a flange of the coil frame, a first wiring portion connected with the external wiring, said second coil terminal comprising a second terminal piece connected with said other end of the winding and secured to the coil frame so as to be substantially contained in the flange of the coil frame, and a second wiring portion connected with the external wiring, said third coil terminal extending from an external wiring portion of the first or second coil terminal, the external wiring portions of said first and second coil terminals and the third coil terminal being secured to the case, and the external wiring portions of said first and second coil terminals being freely disconnectibly coupled with respective terminal pieces of said first and second coil terminals.

* * * * *